US008757293B2

(12) United States Patent
Livingstone

(10) Patent No.: US 8,757,293 B2
(45) Date of Patent: Jun. 24, 2014

(54) AIR HAMMER CORING APPARATUS AND METHOD

(75) Inventor: James I. Livingstone, Calgary (CA)

(73) Assignee: J. I. Livingstone Enterprises Ltd., Calgary (CA)

( * ) Notice: Subject to any disclaimer, the term of this patent is extended or adjusted under 35 U.S.C. 154(b) by 455 days.

(21) Appl. No.: 12/524,326

(22) PCT Filed: Jan. 24, 2008

(86) PCT No.: PCT/CA2008/000170

§ 371 (c)(1),
(2), (4) Date: Nov. 25, 2009

(87) PCT Pub. No.: WO2008/089579

PCT Pub. Date: Jul. 31, 2008

(65) Prior Publication Data

US 2010/0084193 A1 Apr. 8, 2010

Related U.S. Application Data

(60) Provisional application No. 60/886,438, filed on Jan. 24, 2007, provisional application No. 60/980,994, filed on Oct. 18, 2007.

(51) Int. Cl.

| | |
|---|---|
| ***E21B 49/00*** | (2006.01) |
| ***E21B 10/02*** | (2006.01) |
| ***E21B 49/02*** | (2006.01) |

(52) U.S. Cl.
USPC ..... 175/58; 175/248; 175/249

(58) Field of Classification Search
USPC ..... 173/17, 19, 78, 91; 175/58, 244, 248, 175/249, 251
See application file for complete search history.

(56) References Cited

U.S. PATENT DOCUMENTS

| | | | |
|---|---|---|---|
| 1,804,682 | A | 5/1931 | Fosnaugh et al. |
| 2,005,989 | A | 6/1935 | Burt |
| 2,146,263 | A | 2/1939 | Johnston |
| 2,204,844 | A | 6/1940 | Chappell |
| 2,880,969 | A | 4/1959 | Williams |
| 3,064,742 | A | 11/1962 | Bridwell |
| 3,086,602 | A | 4/1963 | Henderson |
| 3,123,158 | A | 3/1964 | Gallus |
| 3,207,240 | A | 9/1965 | Hugel |

(Continued)

FOREIGN PATENT DOCUMENTS

| | | | |
|---|---|---|---|
| GB | 984483 | * | 1/1963 |
| GB | 984483 | A | 2/1965 |

(Continued)

*Primary Examiner* — Giovanna Wright
*Assistant Examiner* — Michael Wills, III
(74) *Attorney, Agent, or Firm* — Bennett Jones LLP

(57) ABSTRACT

A coring method and apparatus is provided for extracting a core sample from a subterranean formation and/or drilling a hydrocarbon well, the coring apparatus having: a pneumatic reciprocating hammer having a first end for operatively connecting the pneumatic reciprocating hammer to a drill string, a second end having a hammer bit and a reciprocating piston for reciprocating the hammer bit; and a coring member operatively connected to the pneumatic reciprocation hammer, the coring member comprising an impact anvil and a hollow coring barrel forming an internal longitudinal chamber for accommodating the core sample, the coring barrel positioned below the impact anvil; whereby when the hammer bit strikes the impact anvil, the coring barrel is driven into the formation and the core sample is extracted into the internal longitudinal chamber of the coring barrel.

36 Claims, 16 Drawing Sheets

(56) References Cited

U.S. PATENT DOCUMENTS

| | | | | | |
|---|---|---|---|---|---|
| 3,302,734 | A | | 2/1967 | Meadors | |
| 3,524,511 | A | | 8/1970 | Klemm | |
| 3,525,408 | A | * | 8/1970 | Mounce | 175/93 |
| 3,548,958 | A | | 12/1970 | Blackwell et al. | |
| 3,807,234 | A | | 4/1974 | Duperon | |
| 3,871,486 | A | | 3/1975 | Curington et al. | |
| 3,934,662 | A | | 1/1976 | Curington et al. | |
| 3,941,196 | A | | 3/1976 | Curington et al. | |
| 3,970,335 | A | | 7/1976 | Curington et al. | |
| 3,986,555 | A | * | 10/1976 | Robertson | 175/246 |
| 3,991,834 | A | | 11/1976 | Curington | |
| 4,002,213 | A | | 1/1977 | Sweeney | |
| 4,105,080 | A | | 8/1978 | Gunning | |
| 4,230,192 | A | | 10/1980 | Pfannkuche | |
| 4,279,315 | A | | 7/1981 | Tibussek | |
| 4,312,414 | A | | 1/1982 | Park | |
| 4,321,974 | A | | 3/1982 | Klemm | |
| 4,449,594 | A | | 5/1984 | Sparks | |
| 4,505,161 | A | | 3/1985 | Hunt et al. | |
| 4,558,749 | A | | 12/1985 | Fulkerson | |
| 4,651,835 | A | | 3/1987 | Davis | |
| 4,716,974 | A | * | 1/1988 | Radford et al. | 175/59 |
| 4,981,183 | A | * | 1/1991 | Tibbitts | 175/244 |
| 5,038,873 | A | * | 8/1991 | Jurgens | 175/246 |
| 5,146,999 | A | | 9/1992 | Wiser et al. | |
| 5,211,715 | A | | 5/1993 | Braden et al. | |
| 5,253,720 | A | | 10/1993 | Radford et al. | |
| 5,351,765 | A | | 10/1994 | Ormsby | |
| 5,360,074 | A | | 11/1994 | Collee et al. | |
| 5,482,123 | A | | 1/1996 | Collee | |
| 5,494,119 | A | | 2/1996 | Tully | |
| 5,546,798 | A | | 8/1996 | Collee et al. | |
| 5,560,438 | A | | 10/1996 | Collee et al. | |
| 6,006,844 | A | * | 12/1999 | Van Puymbroeck et al. | 175/50 |
| 6,098,711 | A | | 8/2000 | Chatterji et al. | |
| RE37,066 | E | | 2/2001 | Casey et al. | |
| 6,305,482 | B1 | | 10/2001 | Aumann et al. | |
| 6,378,631 | B1 | | 4/2002 | Aumann et al. | |
| 6,439,322 | B2 | | 8/2002 | Beck, III | |
| 6,457,538 | B1 | | 10/2002 | Pittard et al. | |
| 6,659,204 | B2 | * | 12/2003 | Hyland et al. | 175/244 |
| 6,890,007 | B1 | | 5/2005 | Parker | |
| 7,204,327 | B2 | * | 4/2007 | Livingstone | 175/318 |
| 7,748,478 | B2 | * | 7/2010 | Swadi | 175/296 |
| 2001/0000393 | A1 | * | 4/2001 | Collee et al. | 175/58 |
| 2002/0129937 | A1 | * | 9/2002 | Cravatte | 166/264 |
| 2006/0237232 | A1 | * | 10/2006 | Cravatte et al. | 175/20 |
| 2007/0048089 | A1 | * | 3/2007 | Ammons | 405/174 |

FOREIGN PATENT DOCUMENTS

| | | | |
|---|---|---|---|
| GB | 1018891 | A | 2/1966 |
| JP | 04124395 | A2 | 4/1992 |
| JP | 11117655 | A2 | 4/1999 |
| JP | 2004068513 | A2 | 3/2004 |

* cited by examiner

AIR HAMMER CORING APPARATUS AND METHOD

This application claims the benefit under 35 USC 119(e) of U.S. Provisional Application No. 60/886,438, filed Jan. 24, 2007 and U.S. Provisional Application No. 60/980,994, filed Oct. 18, 2007.

FIELD OF THE INVENTION

This application relates to an apparatus and method for recovering a core sample from a subterranean formation with minimal damage to the reservoir. The coring apparatus and method can be used with a variety of drill strings such as coil tubing, concentric coil tubing, drill pipe and concentric drill pipe.

BACKGROUND OF THE INVENTION

Extraction of core samples, or coring, is used in a number of different industries such as the mining industry and the oil and gas industry to obtain information on the quantity and quality of various minerals and hydrocarbon deposits.

Much of the current coring equipment uses a drilling fluid such as mud or water to assist in the cutting of the core sample. For example, a coring barrel may be provided at the end of a drill pipe string and the drill pipe rotated so that the diamond hardened tip of the coring barrel is turned into the formation being cored. However, rotating the coring barrel into the formation may cause glazing damage to the formation. Further, the drilling fluid itself may also damage the formation as well as potentially contaminate the core sample.

It is desirable that as pristine a core sample as possible be obtained from a reservoir with as little damage as possible to the reservoir. This is very difficult in the oil and gas industry as both the drilling fluids and the rotation of the coring barrel into the formation can be damaging to the well formation. Core quality is essential or the information obtained from the core sample can be misleading. Geologists, petrophysicists and reservoir engineers must have accurate lithology, porosity and permeability data from the cores they evaluate.

In addition to obtaining uncontaminated cores, is also desirable to retain the integrity of the core sample as much as possible. This is particularly important when pressure coring, where the pressure on the core sample may decrease when the sample is brought to surface. For example, downhole, the oil and/or water in the formation may contain dissolved gas which is maintained in solution by the downhole pressure. As the pressure on the core sample decreases during the trip to the surface, the dissolved gas may come out of solution and be released.

Thus, critical reservoir fluids such as in-situ gases may be lost or contaminated when using traditional coring methods. Information from these fluids can assist in the core evaluation to determine the most effective drilling, completion, stimulation and extraction methods to use. As well, important economic data such as ultimate resource recovery, capital costs and environmental issues can be more closely defined with better quality core information.

Another major problem that exists with many conventional coring devices and methodologies is that the coring devices can only be used with drill pipe, as the coring devices require the drill string to rotate in order to rotate the core cutting barrel for cutting the core. However, the coring device of the present application does not rely on the rotation of the drill string to operate and, thus, can be used with non-rotating single wall or concentric coiled tubing as well as with conventional jointed drill pipe. Thus, the amount of time and drilling expense in obtaining core samples when using jointed drill pipe, i.e., for tripping drill pipe out of a well one joint at a time, picking up the coring equipment, tripping the drill pipe back in one joint at a time, slowly coring the section of interest, tripping the drill pipe back out one joint at a time, picking up your drilling tools and tripping the drill pipe back in one joint at a time, etc. is greatly reduced. With coiled tubing the time required to trip the tubing in and out of the well is a matter of minutes rather than hours.

The coring device described herein uses air or other gases such as nitrogen to operate the coring apparatus to obtain a core sample, thereby avoiding the problems of existing coring devices with respect to formation damage caused by drilling mud, water or other types of drilling fluids. In particular, low pressure reservoirs can be badly damaged by the hydrostatic weight of drilling fluids when used to cut the core. Furthermore, many formations contain clays that swell once they contact water and can give misleading information on reservoir characteristics if contaminated with drilling muds, drilling fluid and/or water.

SUMMARY OF THE INVENTION

This application provides an air hammer coring system that can be operated using a drill string comprising single wall coiled tubing, concentric coiled tubing, joints of single wall drill pipe or joints of concentric drill pipe.

In one aspect, this application provides a coring apparatus for extracting a core sample from a subterranean formation, having:

- a pneumatic reciprocating hammer having a first end for operatively connecting the pneumatic reciprocating hammer to a drill string, a second end having a hammer bit and a reciprocating piston for reciprocating the hammer bit; and
- a coring member operatively connected to the pneumatic reciprocation hammer, the coring member comprising an impact anvil and a hollow coring barrel forming an internal longitudinal chamber for accommodating the core sample, the coring barrel positioned below the impact anvil;

whereby when the hammer bit strikes the impact anvil, the coring barrel is driven into the formation and the core sample is extracted into the internal longitudinal chamber of the coring barrel.

In one embodiment, the pneumatic reciprocating hammer is housed in a carrier and the coring member is operatively connected to the lower end of the carrier. In another embodiment, the coring barrel has spring loaded stoppers at its lower end to ensure that the core sample is retained within the coring barrel when the coring apparatus is removed from the subterranean formation.

In another aspect, this application provides a coring apparatus for extracting a core sample from a subterranean formation, having:

- a pneumatic reciprocating hammer having a first end for operatively connecting to a drill string, a second end having a hammer bit and a reciprocating piston for reciprocating the hammer bit;
- a coring member operatively connected to the pneumatic reciprocating hammer, the coring member comprising an impact anvil and a hollow coring barrel forming an internal longitudinal chamber for accommodating the core sample, the coring barrel positioned below the impact anvil;

a core catcher secured to the lower end of the coring barrel, said core catcher comprising a plurality of blades for either cutting off the core sample when coring is completed, retaining the core sample in the coring barrel, or both; and a coring bit secured to the lower end of the core catcher for cutting through the formation and obtaining the core sample.

In one embodiment, the coring apparatus further comprises a first chemical container for holding a sealant for sealing the bottom of the core sample once the core sample has been cut. In another embodiment the coring barrel is lined with a core liner made from plastic or other materials known in the art for enveloping the core sample. The core liner may be sealed at the top or, in the alternative, a second chemical container may be provided at or near the top of the coring barrel for sealing the top of the core sample when coring is completed.

In another embodiment, the coring member further comprises an outer tube surrounding the hollow coring barrel for receiving material such as cuttings surrounding the cut core for removal at surface.

It is understood that when the coring member is operatively connected to the pneumatic reciprocating hammer, either directly or by means of the carrier housing the pneumatic reciprocating hammer, sufficient space is provided between the face of the hammer bit and the upper surface of the impact anvil so that when a compressed gas such as air, nitrogen and the like is provided to operate the pneumatic reciprocating hammer the face of the hammer bit repeatedly strikes the upper surface of the impact anvil with sufficient force to drive the coring barrel into the formation. In one embodiment, the face of the hammer bit is substantially flat to increase the surface area of the hammer bit impacting the impact anvil.

In another aspect, this application provides a method for obtaining a core sample from a subterranean formation and/or drilling a hydrocarbon well, comprising:

operatively connecting a pneumatic reciprocating hammer to a drill string, the pneumatic reciprocating hammer having a hammer bit at its lower end;

operatively connecting a coring member to the pneumatic reciprocating hammer, the coring member comprising an impact anvil and a hollow coring barrel forming an internal longitudinal chamber for accommodating the core sample, the coring barrel positioned below the impact anvil; and supplying a gas through the drill string to the pneumatic reciprocating hammer for operating the pneumatic reciprocating hammer so that the hammer bit repeatedly strikes the impact anvil to force the coring barrel into the formation.

In one embodiment, the method further comprises operatively connecting the air hammer to the drill string by means of a rotating sub. The rotating sub will slowly rotate the pneumatic reciprocating hammer and coring member to facilitate the cutting of the core sample.

Thus, the present method can obtain a core sample without using drilling fluid such as drilling mud or water and without having to rotate the drill string from surface in order to cut the core sample. It is the repeated striking of the hammer bit on the anvil that drives the coring barrel into the formation. Hence, in addition to being able to core with jointed drill pipe, coring can be done using single wall coiled tubing or concentric coiled tubing. In one embodiment, the coring barrel further comprises at least one cutter to aid in the cutting of the core sample. In another embodiment, a separate coring bit as known in the art is provided at the end of the coring barrel, which bit can be integral with the coring barrel or can be a detachable separate member.

In another aspect, the coring method can be used to obtain pressure core samples by providing a sealant for sealing the bottom or the top or both of the core sample once coring is completed. A core liner can also be provided for receiving and enveloping the core sample when it enters into the coring barrel.

The air hammer coring system of the present invention can also be used to drill a hydrocarbon well with minimum damage to the hydrocarbon bearing zone. By way of example, conventional drilling technologies that use drilling fluids such as drilling muds, water, gases, etc. can be used to drill the well bore to an area just above the hydrocarbon bearing zone. Damage to these non-producing zones is not critical. However, continuation of conventional drilling through the hydrocarbon bearing zone could now cause substantial damage to the zone. Instead, the present air hammer coring apparatus can be added to the drill string and the coring barrel can be used to cut through the hydrocarbon bearing formation to form a producing well. At this point production string can be run into the well or it can be left as an open hole completion well. Thus, the well has been completed with minimal damage to the hydrocarbon producing zone. When the coring apparatus of the present invention is used for drilling a hydrocarbon well, the core sample may be analyzed or simply discarded when drilling is completed.

Other features will become apparent from the following detailed description. It should be understood, however, that the detailed description and the specific embodiments while indicating preferred embodiments of the invention are given by way of illustration only, since various changes and modifications within the spirit and scope of the invention will become apparent to those skilled in the art from this detailed description.

DETAILED DESCRIPTION OF THE PREFERRED EMBODIMENTS

Figure 1A:
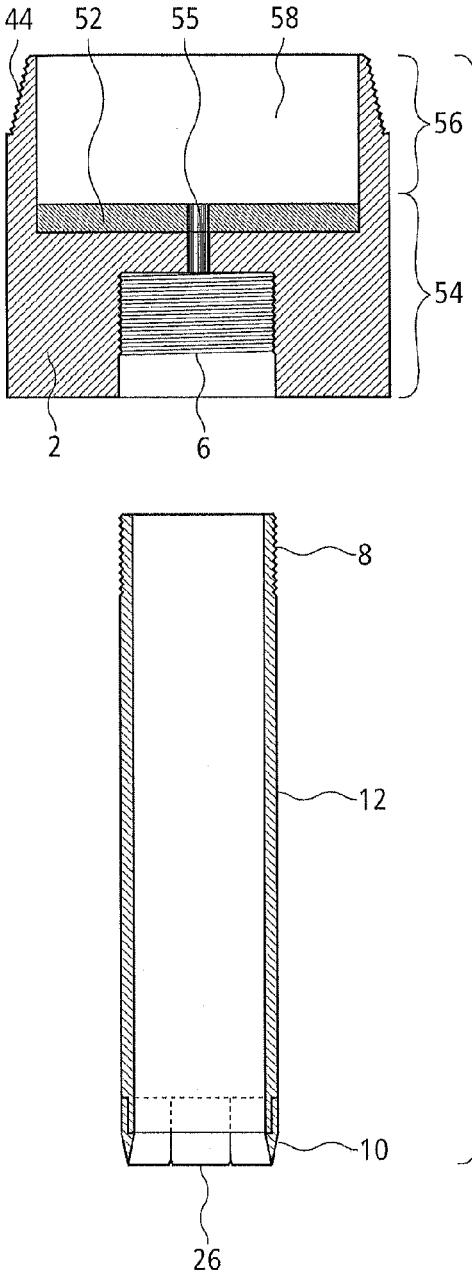
FIG. 1*a* is a vertical cross-section of an impact sub and a coring barrel that thread together to form an embodiment of the coring member of the present invention.

While the invention is described below with reference to what are presently considered to be the preferred embodiments, it is to be understood that the invention is not limited to the disclosed embodiments. To the contrary, the invention herein is intended to cover various modifications and equivalent arrangements included within the spirit and scope of the appended claims.

In one embodiment of the air hammer coring apparatus, the impact anvil has an outer surface dimension (e.g., outer diameter) that is substantially larger than the outer surface dimension of the coring barrel such that when the bottom surface of the impact anvil is flush with the original coring point in the well bore, the coring barrel will be full and the apparatus can be tripped out of the well using the drill string. In another embodiment, the outer surface dimension of the impact anvil may be substantially the same as the outer surface dimension of the coring barrel, in which case surface measurement instruments known in the art are used to determine the coring depth and gauge when the coring barrel is full.

In one embodiment, the coring barrel has at least one cutter at its lower end for cutting into the subterranean formation. In one embodiment, the at least one cutter is made from a special harden material, such as polycrystalline diamond compact cutters (PDC cutters), which are well known in the industry. The use of cutters such as PDC cutters will allow one to obtain core samples in the hardest of rock formations. It is understood, however, that various cutting designs for the bottom of the coring barrel can be used depending on the characteristics of each formation. For example, in one embodiment, a coring bit is provided at the end of the coring barrel, which can be integral with the coring barrel or can be a detachable separate member.

In one embodiment, a coring bit is provided that is designed to form a borehole having the same dimensions as the drilled borehole so that the cored portion of the well does not have to be drilled once the coring process is completed. In this embodiment, it may be desirable that the interior dimensions of the coring barrel be as large as possible without compromising the strength and durability of the coring barrel to accommodate such a large core. For example, without being limiting, if a 6¼ inch diameter borehole is desired, the outer dimensions of the coring barrel would have to be slightly smaller (e.g. about 6 inches in diameter) to ensure that the tool does not get stuck in the borehole. However, to preserve the strength of the coring barrel, the inner diameter of the coring barrel would likely be about 5 inches. Thus, in this embodiment, coring would be completed when the coring barrel is about 80% into the formation. Hence, cores can be cut that are hundreds of feet long without having to drill the core sample zone once coring is completed.

In the alternative, in one embodiment, an outer tube can be provided having an outer surface dimension which is slightly smaller than the borehole (for example, the outer tube may have an outer diameter of about 6 inches when used in a 6¼ inch borehole) which surrounds the coring barrel. Thus, the excess cuttings formed during coring can be received in the annulus between the outer tube and the coring barrel and later removed at surface.

In one embodiment, the interior of the coring barrel can be lined with a core liner as is known in the art. In one embodiment, the core liner has a closed top end and an open bottom end for receiving the core sample. In another embodiment, a core catcher is provided which is designed to cut the core when coring is completed and retain the core sample in the coring barrel until it is removed from the coring barrel at surface. In one embodiment, a first chemical container is provided which contains a sealant for sealing the bottom of the core sample once the core catcher has cut the core. A second chemical container may also be provided containing a sealant for sealing the top of the core sample as well. It is understood that the type of sealant to be used is dependent upon the characteristics of the formation being sampled.

For example, a polyalkylene derivative such as polyethylene, polyethylene glycol or polypropylene glycol, or mixtures thereof, may be used, as described in U.S. Pat. No. 5,560,438, incorporated herein by reference. Such sealants are generally capable of increasing in viscosity in response to a decrease in temperature during transport of the core to surface, thereby protecting the integrity of the core sample. A non-invading gel such as described in U.S. Pat. No. 5,482,123, incorporated herein by reference, may also be used.

When a formation is believed to contain mainly crude oil and very little gas or water, a sealant comprising plasticizing and filtering agents dispersed in a water-based dispersant might be used. The plasticizing agents are preferably water expandable, lattice-type clays (see, for example, U.S. Pat. No. 5,546,798, incorporated herein by reference). In some instances, a non-intrusive metal can be used to form a metal plug at one or the other or both ends of the core sample once coring is completed. Metal alloys having a melting point from about 150° F. to about 225° F. cover a wide range of different wells (see U.S. Pat. No. 2,146,263, incorporated herein by reference).

U.S. Pat. No. 4,505,161, incorporated herein by reference, describes a process for preserving mineral samples comprising sealing the sample with a material comprising a nitrile oxygen barrier resin formed by the polymerization of 55 to 90 weight percent of an olefinically unsaturated monomemitrile with a remaining portion of at least one monovinyl monomer copolymerizable with the nitrile, for example, in the presence of a preformed diene rubber. Finally, U.S. Pat. No. 6,098,711, incorporated herein by reference, provides compositions comprising an aqueous rubber latex, a rubber latex activator for causing the latex to harden, an organosilane and a filler, which produces a highly resistant solid sealant.

In one embodiment, where the pneumatic reciprocating hammer is housed in a carrier, the carrier comprises at least one locking mechanism for locking the reciprocating air hammer in place. In another embodiment, the first end of the pneumatic reciprocal hammer comprises pin threads and the hammer is thread connected to the drill string. The compressed gas (usually air or nitrogen) used to power the pneumatic reciprocating hammer is carried from a surface compressor system 99 (shown in FIG. 12) for reciprocating the hammer piston. Depending upon whether single wall drill string or dual wall drill string is used, the pneumatic hammer may be a conventional air hammer or a reverse circulating air hammer, respectively. It is understood that any pneumatic reciprocating hammer known in the art can be adapted for use in the present invention.

The coring member is preferably made of hardened steel or other suitable material. In one embodiment, the impact anvil of the coring member has an additional layer of hardened material such as stainless steel, tungsten carbide, brass, carbon steel with industrial diamond coating, and the like. In one embodiment, where the pneumatic reciprocating hammer is housed in a carrier, both the upper end of the coring member and the lower end of the carrier are threaded for easy connection of the coring member to the carrier.

In one embodiment, the coring barrel is integral with the impact anvil. In another embodiment, the coring barrel is removably attached to the impact anvil. For example, the bottom portion of the impact anvil may be internally threaded and the coring barrel may be externally threaded so that the coring barrel can be threaded into the impact anvil during coring but be removed after coring for easy removal of the core sample therein.

The pneumatic hammer coring apparatus of the present invention is designed to fit within the diameter of the existing well bore. Once it reaches the coring point, the pneumatic reciprocating hammer is activated to drive the coring barrel into the formation by supplying compressed gas to the reciprocating pneumatic hammer piston. It is understood by those skilled in the art that the coring barrel can be of various lengths, but it must be able to come out of the well bore, close the surface BOP system and still fit within the height of the rig's derrick when using drill pipe. Coil tubing drill strings also limit the length of the coring barrel due to the surface BOP system and the height of the coil tubing injector system.

In the embodiment where the coring barrel is separate from the impact anvil, it may be advantageous that the top of the coring barrel be made of harden metal and may have diamond material added to prevent excessive wear from the pounding action of the hammer.

In one embodiment, the air hammer coring apparatus further comprises a rotating sub operatively connected at or near the first end of the pneumatic hammer to rotate the coring apparatus so that the coring bit does not always strike the same area of the formation. For example, the threaded first end of the pneumatic reciprocating hammer can be threaded directly to the rotating sub and the rotating sub can then be operatively connected to the drill string.

As mentioned, the embodiments of the invention will allow the cutting of an uncontaminated core sample using either coil tubing (single or concentric) or drill pipe (single or concentric). Where timing and costs are of concern, the use of a coil tubing operated air hammer coring apparatus will offer a cost effective solution. A quick retrieval of cores in coal bed methane is very important in calculating methane levels and coil tubing air hammer coring can provide that service.

The air hammer coring apparatus and method will be described with references to the following preferred embodiments and Figures thereto.

Figure 1B:
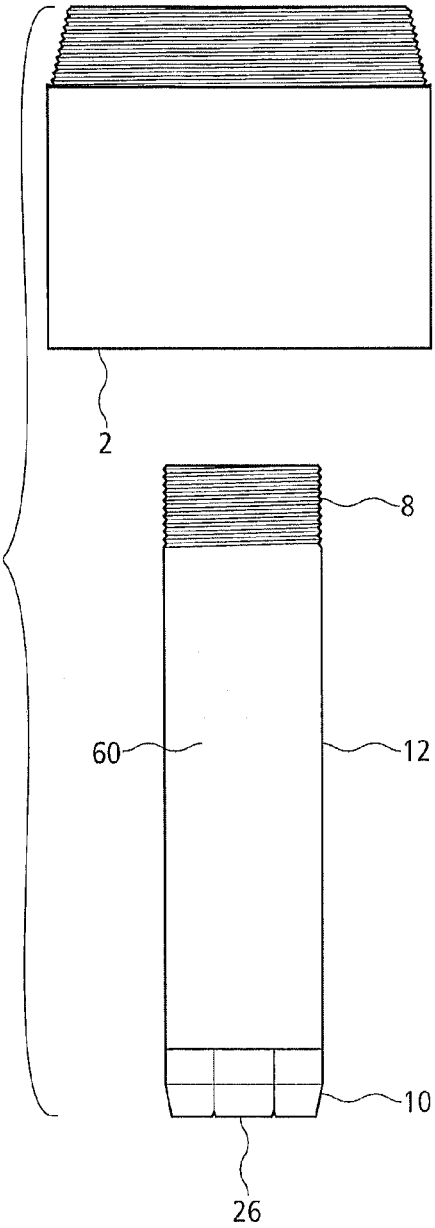
FIG. 1*b* is a perspective of the impact sub and coring barrel of FIG. 1*a*.

FIGS. 1*a* and 1*b* schematically illustrate an embodiment of a disassembled coring member of the present invention. In this embodiment, coring member 50 comprises impact sub 2 and coring barrel 12. Impact sub 2 comprises a substantially solid cylindrical bottom portion, impact anvil 54, and a substantially hollow cylindrical top portion 56, which top portion 56 ends in threaded pin end 44. Top portion 56 of impact sub 2 forms a space 58 for receiving the hammer bit of the pneumatic reciprocating hammer (see FIG. 2) so that the hammer bit will repeatedly impact on impact anvil 54. In this embodiment, impact anvil 54 further comprises internally threaded box 6 for receiving coring barrel 12 to form the assembled coring member.

In one embodiment, the impact sub further comprises at least one venting means 55 for releasing any build up of pressure that may occur in the coring barrel during coring. In another embodiment, a top layer 52 of a special harden material is provided to give the impact anvil 54 additional strength to prevent wear and metal fatigue due to the continuous impact of the hammer bit of the pneumatic reciprocating hammer on the impact anvil.

Coring barrel 12 may be made of special alloy steel to give it strength to absorb the pounding motion of the pneumatic reciprocating hammer. In one embodiment (not shown), the top portion of the coring barrel may be of a greater thickness that the bottom portion, as this is the part of the coring barrel that generally receives the greatest impact and wear. It is understood that the coring barrel can vary in length, circumference, inner diameter and outer diameter, depending upon the formation and the size of sample needed to be cored and evaluated. Usually coring barrels can range anywhere from 5 feet to 40 feet in length or longer. It is understood that longer coring barrels may be comprised of several individual sections that can be threaded together to form a continuous coring barrel.

In the embodiment shown in FIGS. 1*a* and 1*b*, special diamond chisel cutters 26, such as PDC chisel cutters, are attached at the bottom end of the coring barrel 12 by separately welding, forging, threading, etc., each to the end of the coring barrel 12. Thus, if one or more of the cutters break or become dull, they can be easily replaced. It is understood that a separate coring bit such as a chisel bit having at least one chisel cutter could also be used.

Figure 1C:
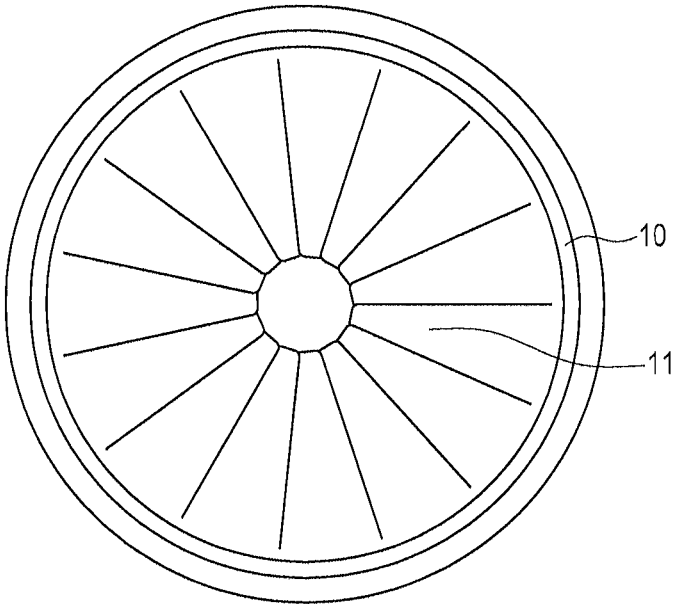
FIG. 1*c* is a perspective of the bottom of a coring barrel where a core catcher has been attached to the coring barrel.
Figure 1D:
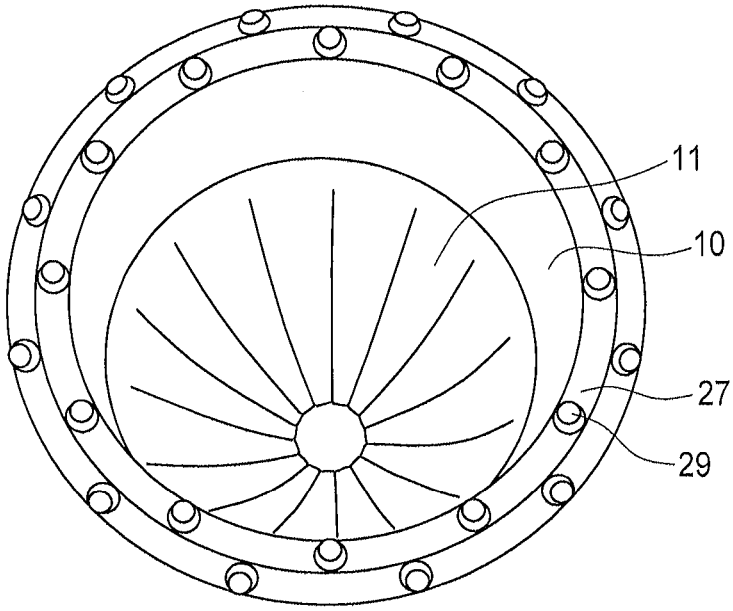
FIG. 1*d* is a perspective of the bottom of a coring barrel when both a core catcher and a coring bit have been attached to the coring barrel.

A coring bit 27 as shown in FIG. 1*d* can also be used, said coring bit having a large passageway therethrough and a plurality of cutting elements 29 positioned along the perimeter of the bit 102 for cutting into the formation. The distance between the innermost cutting elements 29 define the diameter of the core that will be cut with such a bit 27. The outer cutting elements 29 also define an outer diameter which will cut the borehole to a size sufficient to allow the rest of the coring apparatus to enter the borehole. In one embodiment, the cutting elements define an outer diameter that is essentially the same as the drilled wellbore being cored so that the formation does not have to be drilled out after the core sample has been obtained. Of course, it is understood by those skilled in the art that various types and configurations of coring bits may be employed so long as the bit can cut a core sample having an outer diameter that will fit within the coring barrel.

As shown in FIGS. 1*c* and 1*d*, coring member 50 can further comprise a core catcher 10 for both cutting off the core sample when coring is completed and retaining the core sample in the coring barrel for retrieval. Core catcher 10 is shown attached to coring barrel 12 and comprises a plurality of spring loaded blades 11 for cutting off the core sample. When the blades are fully extended horizontally, the core catcher 10 is in the closed position. However, during coring, the blades 11 are pushed towards the wall of the core catcher/core barrel and the core catcher is thus in the open position to allow the core sample to enter the coring barrel. Once coring is completed, the spring loaded blades 11 will close again to cut the core sample and prevent it from falling out the bottom of the coring barrel. However, it is understood that any core catcher known in the art can be used.

As shown in FIG. 1*d*, the core catcher 10 is threaded on to the bottom of the coring barrel 12 first and then the coring bit 27 is threaded onto the core catcher 10. Thus, the core catcher 10 is place just above the coring bit 27 to prevent the core sample from falling out the bottom of coring barrel 12 as it pulled out of the well bore.

As shown in FIGS. 1*a* and 1*b*, at the top end of coring barrel 12 is threaded pin end 8, which end 8 can be threaded into internally threaded box 6 of impact sub 2 to form the assembled coring member 50. Core sample 60, once on surface, can be easily recovered from 12 by unscrewing the coring barrel 12 from the impact sub 2. It is understood, however, that coring member 50 could be manufactured as a single tool where the coring barrel 12 is not removable but integrally attached to the impact sub 2.

Figure 2:
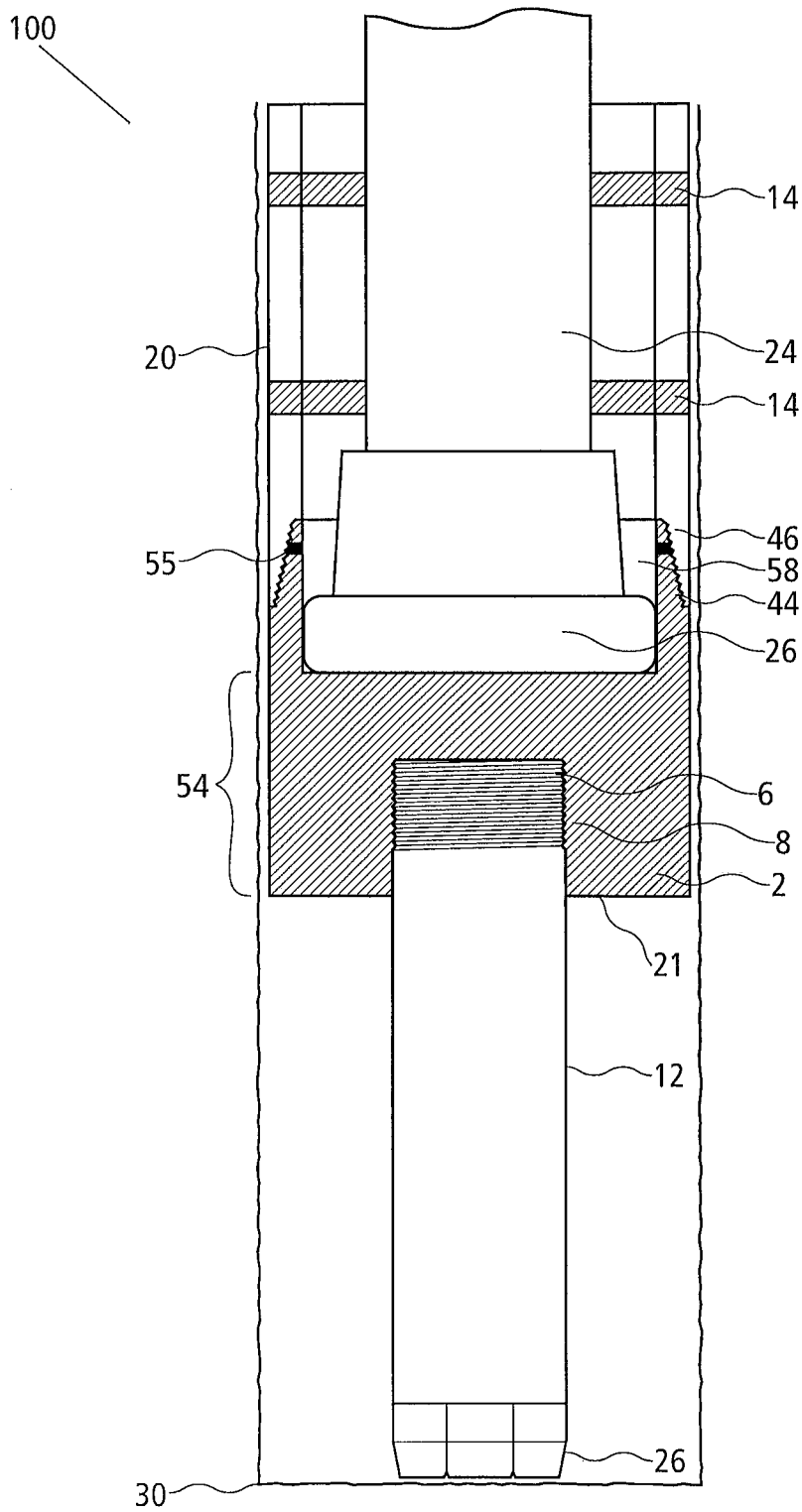
FIG. 2 is a vertical cross-section of an embodiment of a pneumatic hammer coring apparatus in the assembled position.

FIG. 2 schematically illustrates one embodiment of the pneumatic or air hammer coring apparatus 100 of the present invention (in the assembled position), which comprises coring member 50 as shown in FIGS. 1*a* and 1*b*. A substantially cylindrical carrier 20 is provided having a bottom box threaded end 46 and an optional top pin threaded end (shown as element 22 in FIG. 3). Contained within the carrier 20 is pneumatic reciprocating hammer 24, which is secured to carrier 20 by at least one locking mechanism 14, and comprises a flattened hammer bit 26 at one end. The other end of pneumatic hammer 24 is attached to drill string by threads or other connection means known in the art (not shown). It is understood that most pneumatic reciprocating hammers known in the art can be modified for the present application, where preferably existing drill bits would be replaced with flattened hammer bits such as shown in FIG. 2.

Box threaded end 46 of carrier 20 is threaded onto threaded pin end 44 of impact sub 2 so that flattened hammer bit 26 occupies space 58 and impacts on the face of impact anvil 54. Coring barrel 12 is joined to impact sub 2 by threading pin thread end 8 of the coring barrel 12 into internally threaded box 6 of impact anvil 54.

The pneumatic reciprocating hammer 24 comprises a reciprocating air piston (not shown), which drives the flattened hammer bit 26 up and down. The impact of the flattened hammer bit 26 on impact anvil 54 and subsequently on coring barrel 12 drives coring barrel 12 into the formation at coring starting point 30. When the bottom end 21 of impact anvil 54 is flush with coring point 30, the coring operation is complete and coring apparatus 100 is tripped out of the well bore to surface by tripping out the drill string. As previously mentioned, drill string can be single wall coiled tubing, single wall drill pipe, concentric coiled tubing or concentric drill pipe.

In order to prevent the escape of hydrocarbons (e.g., gas) from the subterranean formation up into the space 58 which receives the flattened hammer bit during operation of the pneumatic hammer coring apparatus 100 of the present invention, and, in particular, when the pneumatic hammer coring apparatus is being used for coring or well completion in a hydrocarbon producing zone, a series of replaceable O-rings 55, of a type well known in the industry, can be fitted around impact sub 2 to form a substantially air tight seal between the inside wall of the carrier 20 and the outside wall of impact sub 2 during operation. Thus, no hydrocarbons can escape up into space 58 above the impact sub 2 during the coring/completion process.

Figure 3:
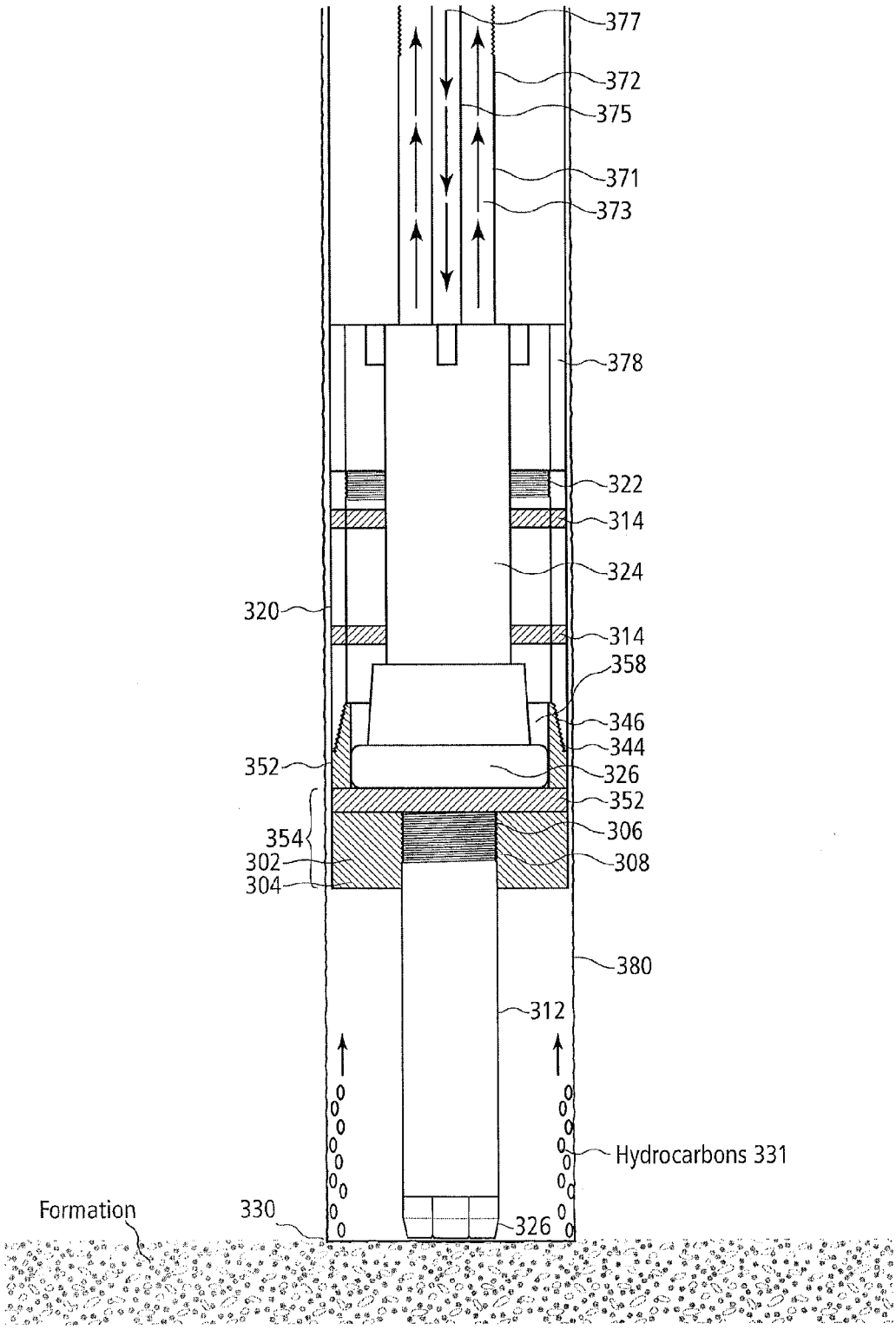
FIG. 3 is a vertical cross-section of an embodiment of a pneumatic hammer coring apparatus operated by a concentric drill string.

FIG. 3 shows an embodiment of the coring apparatus 300 of the present invention being operated by concentric drill string 371. In this embodiment, the coring member comprises impact sub 302 and coring barrel 312. Impact sub 302 comprises a substantially hollow cylindrical top portion 356, which top portion 356 ends in threaded pin end 344, and impact anvil 354. Impact anvil 354 comprises a bottom section 304 and a top section 352 made of special hardened material. Bottom section 304 further comprises internally threaded box 306 for receiving the threaded pin end 308 of coring barrel 312 to form the assembled coring member.

Concentric drill string 371 comprises an inner tube 375 and an outer tube 372 and the hammer is a reverse circulating pneumatic reciprocating hammer as is known in the art. Compressed gas 377, for example, air, nitrogen, mixtures of air and nitrogen, etc., is used to operate the reverse circulating pneumatic reciprocating hammer 324 and is pumped through inner tube 375 and returns to surface through annulus 373 between the outer tube 372 and inner tube 375. Hydrocarbons 331 that may be released from formation 330 and migrate to surface between the formation wall 380 and the outside wall of the air hammer coring apparatus 300 can be prevented from escaping by means of a surface blowout preventor (surface BOP) as is known in the art. In the event that hydrocarbons escape up through either the inner tube 375 or annulus 373, a downhole flow control means, for example, as described in U.S. Pat. No. 6,892,829, incorporated herein by reference, can be used to prevent this from occurring.

In a preferred embodiment, a rotating sub 378 is provided, which is attached to carrier 320 by threading means 322. The rotating sub 378 slowly rotates the pneumatic hammer coring apparatus 300 so that the cutters 326 can slowly rotate thereby aiding in the cutting of the core sample.

Figure 4:
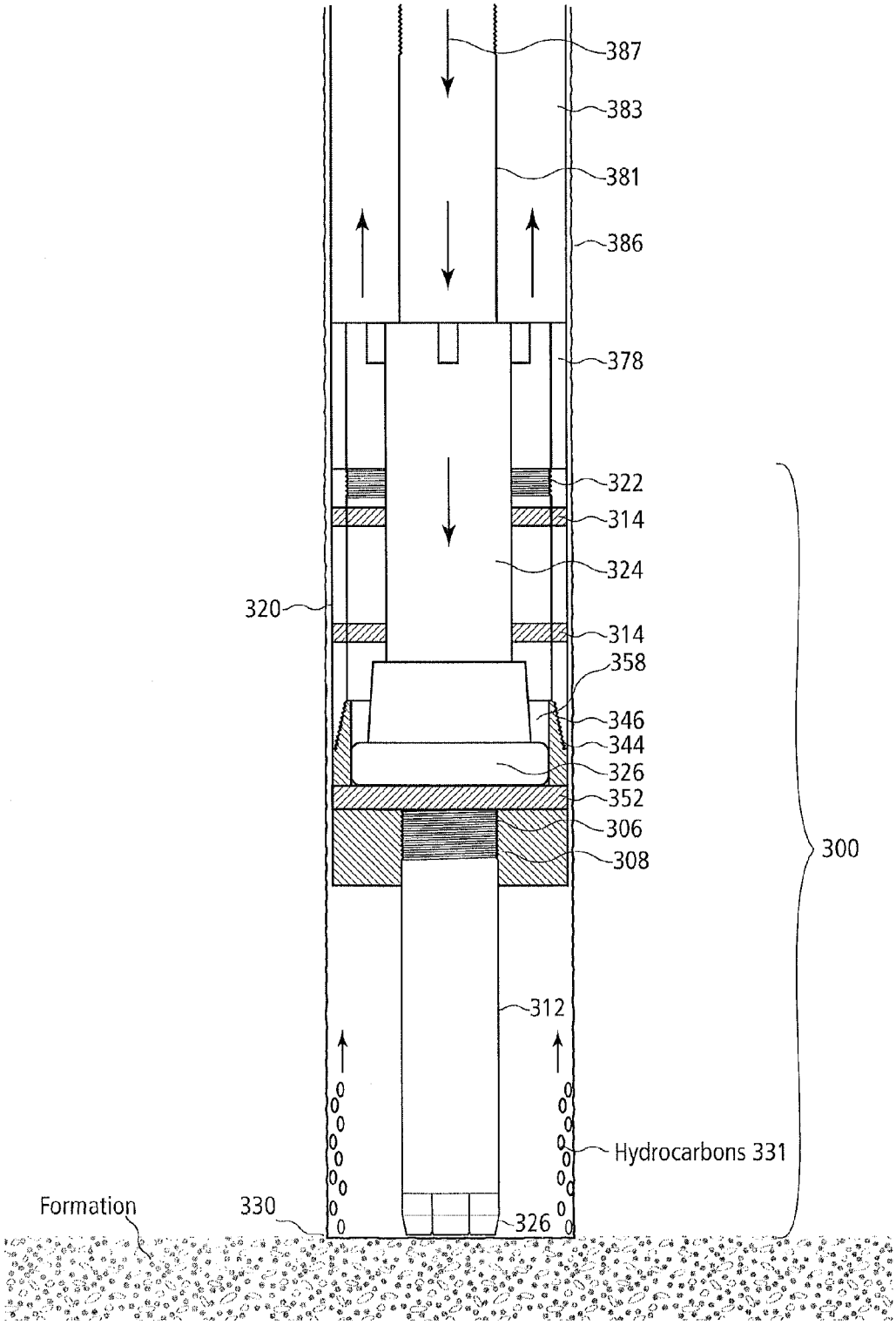
FIG. 4 is a vertical cross-section of an embodiment of a pneumatic hammer coring apparatus operated by a single wall drill string.

FIG. 4 shows the pneumatic hammer coring apparatus 300 being operated by a single wall drill string 381. In this instance, drilling gas 387, for example, air, nitrogen, mixtures of air and nitrogen, etc., is pumped through drill string 381 and returns to surface through annulus 383 formed between the drill string 381 and the well bore wall 385. As was shown in FIG. 3, rotating sub 378 may be used, in particular, when using coil tubing, to provide a very low RPM rotation. This prevents the cutters 326 of coring barrel 312 from striking the formation at the same spot. This is particularly important when sampling hard formations such as rock.

Figure 5A:
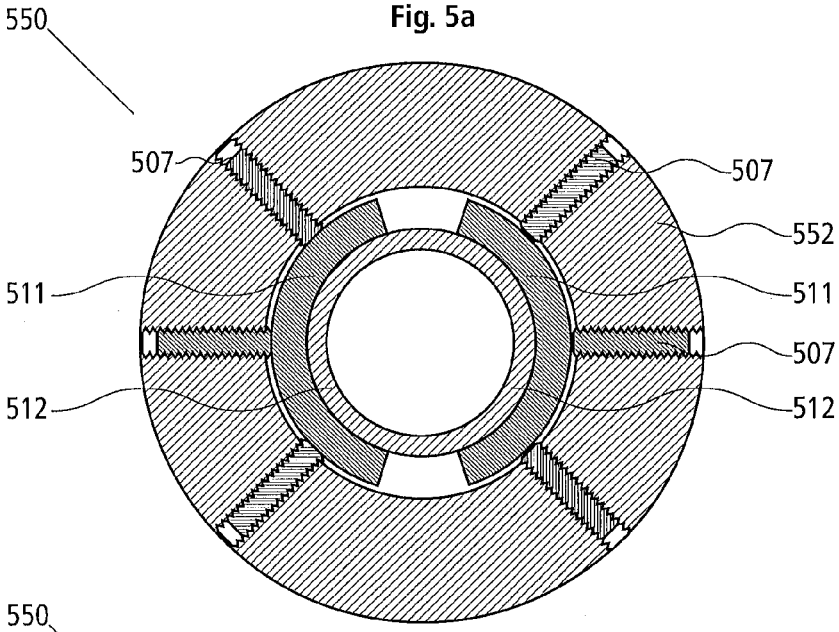
FIG. 5*a* is a vertical cross-section of an impact sub and a coring barrel that are clamped together to form another embodiment of the coring member of the present invention.
Figure 5B:
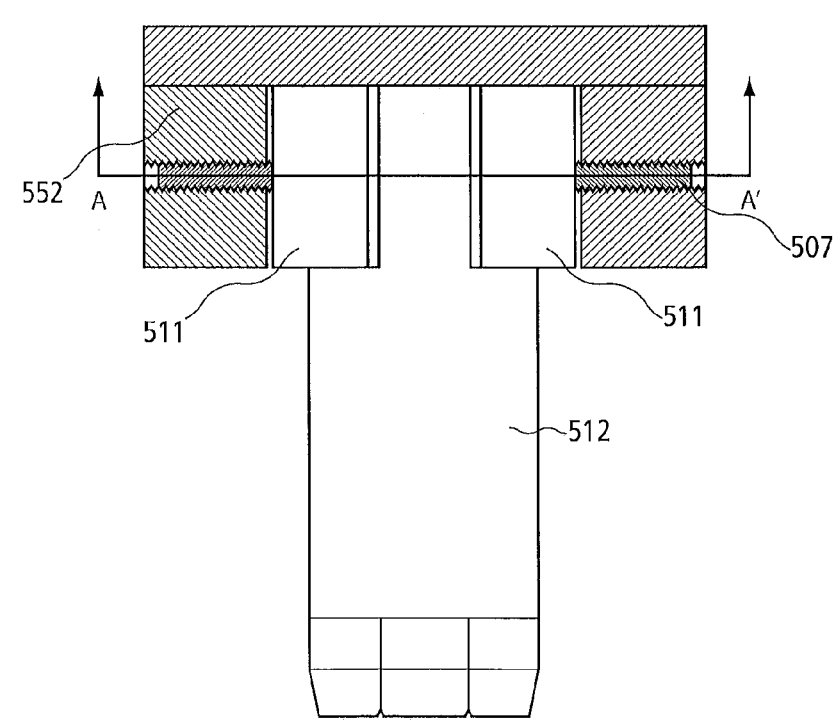
FIG. 5*b* is a horizontal cross-section of the coring member of FIG. 5*a* across line A-A'.

FIG. 5*a* schematically illustrates another embodiment of a coring member 550 of the present invention. In this embodiment, coring barrel 512 is attached to impact anvil 552 by two pipe clamps 511, which clamps are securely held in place against the top of the coring barrel 512 with a plurality of set screws 507. Thus, in this embodiment the coring barrel 512 is a non-threaded coring barrel. FIG. 5*b* is a horizontal cross-section across line A-A', which shows that pipe clamps 511 are set by set screws 507 to secure coring barrel 512. It can be seen from FIG. 5*b* that impact anvil 552 has a greater outer diameter that coring barrel 512. Thus, coring will be completed when the bottom of the formation to be sampled meets the bottom surface of impact anvil 552.

Figure 6A:
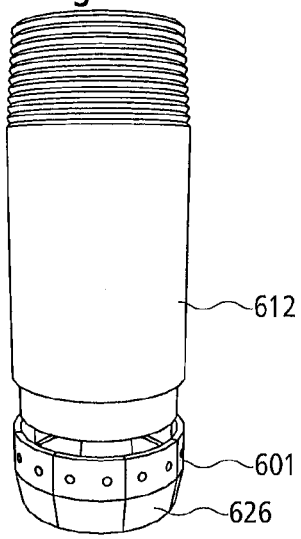
FIGS. 6*a* and 6*b* schematically illustrate a coring barrel with a removable coring bit.
Figure 6B:
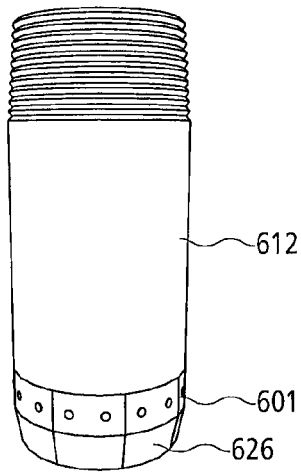
Figure 7A:
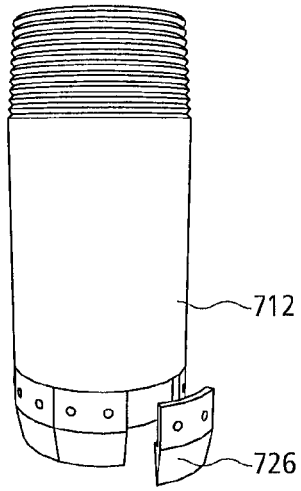
FIGS. 7*a* and 7*b* schematically illustrate a coring barrel having individual removable cutters.
Figure 7B:
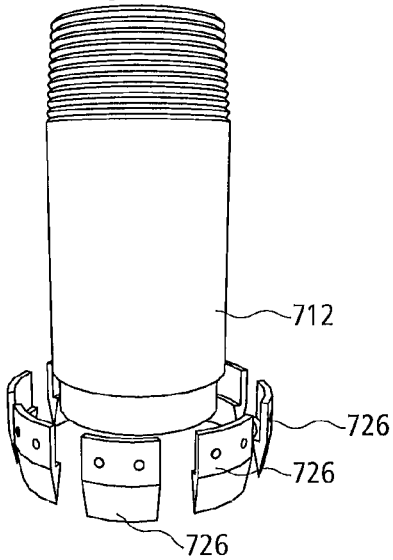
Figure 7C:
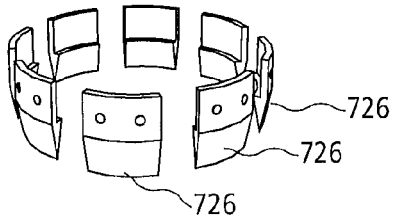
FIG. 7*c* illustrates the individual removable cutters of an embodiment of the present invention.

FIGS. 6*a* and 6*b* show coring barrel 612 having a removable coring bit 601 attached at the bottom. Coring bit 601 is comprised of a plurality of individual cutters 626. It is understood, however, that a coring bit having a single cutter or blade may also be used. FIGS. 7*a*, 7*b* show coring barrel 712 having individual cutters 726 attached to the bottom. The individual cutters 726 can be more clearly seen in FIG. 7*c*. It is understood that the number of individual cutters required on the coring barrel can vary, depending on the size of the individual cutters, the coring barrel, etc. Each cutter may be PDC Blade Cutters that can be used in place of standard coring bits for harder formations and can be individually replaced as they become damaged or dull.

Figure 8:
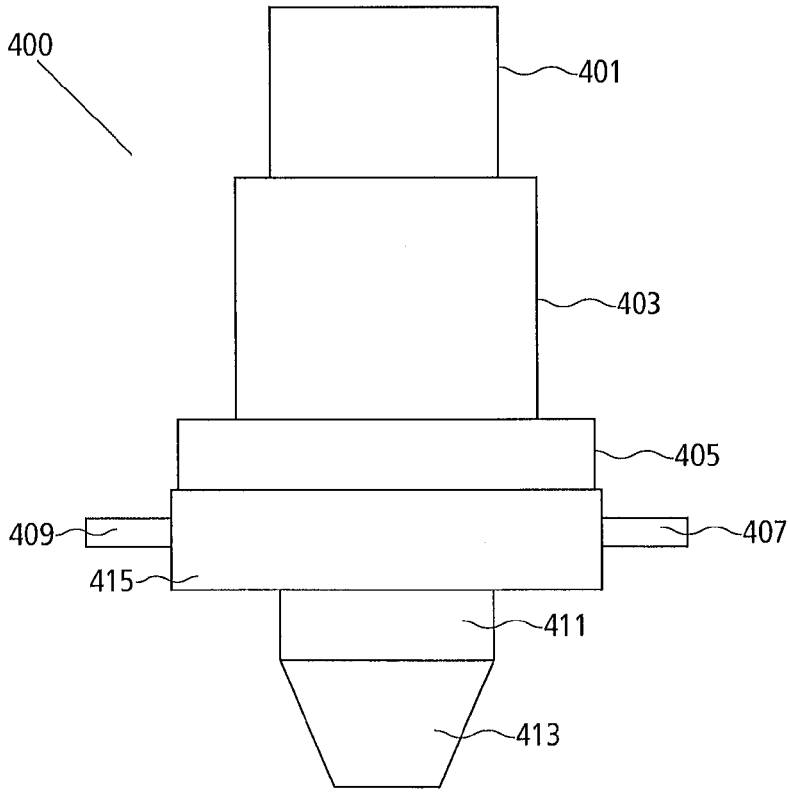
FIG. 8 schematically illustrates a surface blowout preventer system for well control in hydrocarbon formations during the sampling process.

As previously mentioned, for safety reasons, it may be necessary to operate the air hammer coring apparatus of the present invention with a surface blowout preventer (BOP). FIG. 8 shows one embodiment of a surface BOP, surface BOP 400, which is commonly referred to in the industry as an annular and blind ram BOP. Use of such a surface BOP will prevent any uncontrolled flow of hydrocarbons at surface while the coring operation is taking place. Surface BOP 400 can be used with either jointed drill pipe or coiled tubing.

Surface BOP 400 comprises the following elements. Rotating head 401 seals around drill string while drilling and prevents hydrocarbons from being released on the rig floor. Annular preventer 403 seals off the annulus between the formation wall and the outside of the drill string. Blind rams 405 closes the well bore when the drill string is out of the well. Venturi eductor 407 is attached to working spool 415 and can be used to evacuate gas from the well when running casing, tubing or coring tools into the well. Kill line 409 is used to pump kill fluids down the well bore in the event of an uncontrolled flow to surface.

Surface BOP 400 further comprises production casing spool 411, which is used to hang the production string in the well bore once the well is completed. Surface casing bowl 413 ties the BOP stack to the surface casing of the well.

Figure 9:
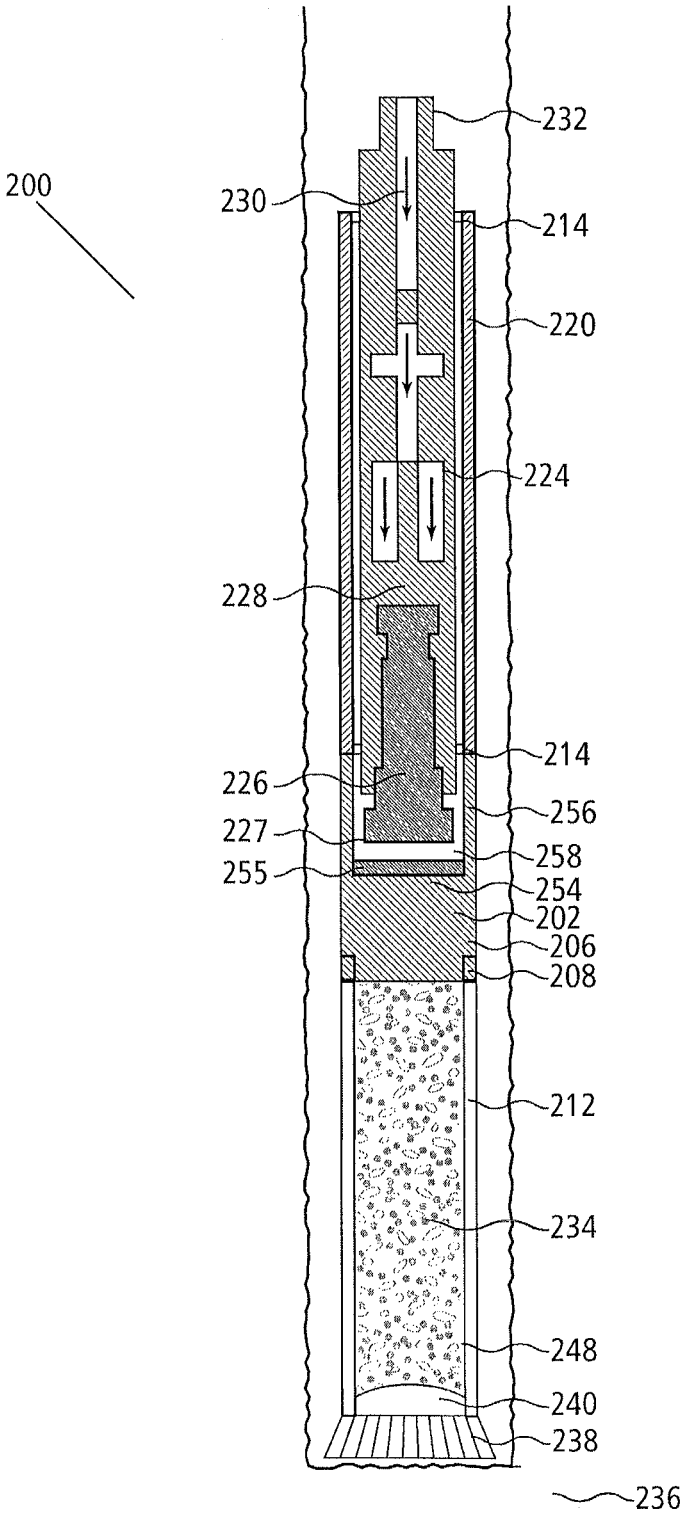
FIG. 9 is a vertical cross-section of another embodiment of a pneumatic hammer coring apparatus of the present invention.

FIG. 9 illustrates another embodiment of the present invention. In this embodiment, the air hammer coring apparatus is being used to not only obtain a core sample but also to form a borehole having an inner diameter such that the cored formation does not have to be drilled after coring is completed.

Pneumatic or air hammer coring apparatus 200 comprises pneumatic reciprocating hammer 224 housed in carrier 220 and coring member comprising impact sub 202 and coring barrel 212 attached to impact sub 202 by means of threaded pin end 208 being threaded into internally threaded box 206. Top portion 256 of impact sub 202 is operably connected to carrier 224 and coring barrel 212 is operably connected to impact anvil 254. Coring barrel 212 further comprises coring bit 238, which coring bit forms a borehole in the formation that is slightly larger that the outer surface dimension of the pneumatic hammer coring apparatus 200.

In this embodiment, the coring bit 238 is selected to form a borehole substantially having the same inner diameter as the original borehole so that the cored formation does not have to be drilled again. Thus, once the core sample 234 is obtained, drilling can reconvene at the point where coring stopped. Coring barrel 212 also comprises core catcher 240 as is known in the art to ensure that core sample 234 does not fall out of the bottom of the coring barrel when the apparatus is tripped out of the borehole. Further, coring barrel 212 may be lined with an interior plastic lining 248 to facilitate the removal of the core sample 234. As can be seen in FIG. 9, the exterior dimensions of coring bit 238 is slightly larger than the pneumatic hammer coring apparatus 200 so that the apparatus does not get stuck in the hole.

Pneumatic reciprocating hammer 224 is secured to carrier 220 by locking means 214. Pneumatic reciprocating hammer 224 comprises hammer W bit 226, which is operably connected to reciprocating hammer piston 228, so that when compressed gas 230, such as compressed air, is supplied through the drill string (not shown) to the hammer 224 and to piston 228, the piston operates to move the hammer bit 226 up and down through space 258 and the flattened end 227 of the hammer bit 226 strikes the face 255 of impact anvil 254 forcing the coring barrel 212 to cut through formation 236.

Figure 10:
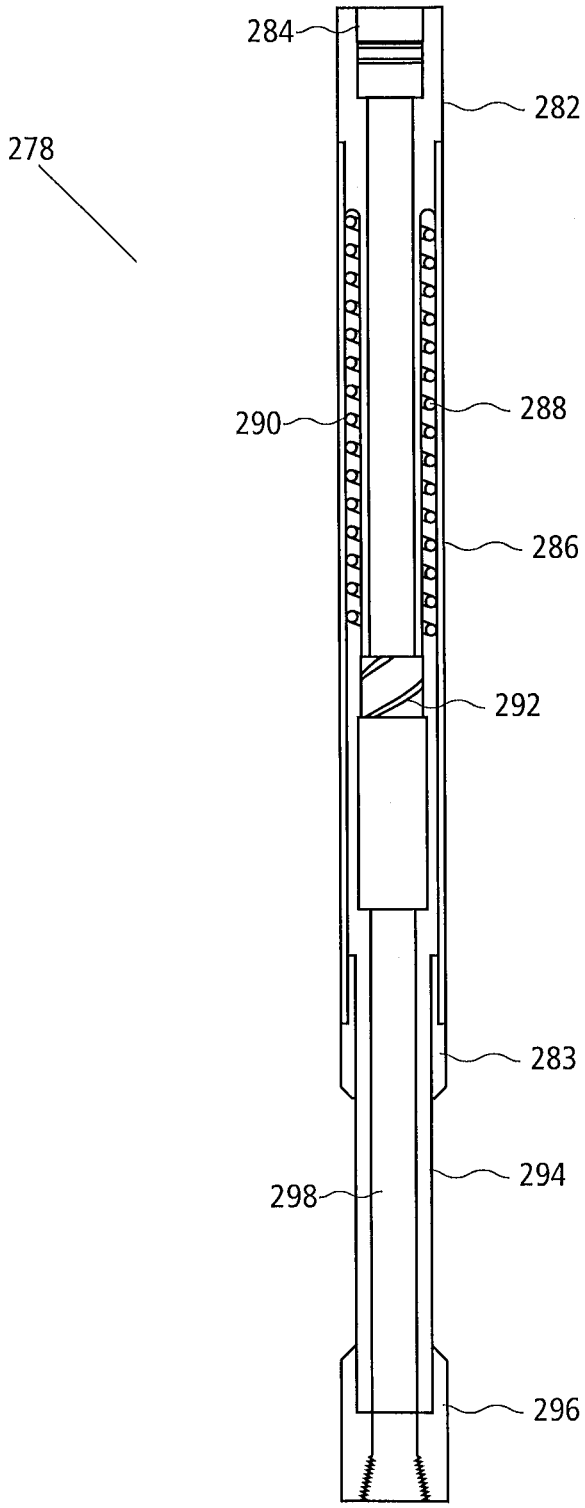
FIG. 10 is a vertical cross-section of one embodiment of a rotating sub which can be used in the present invention.
Figures 11A, 11B:
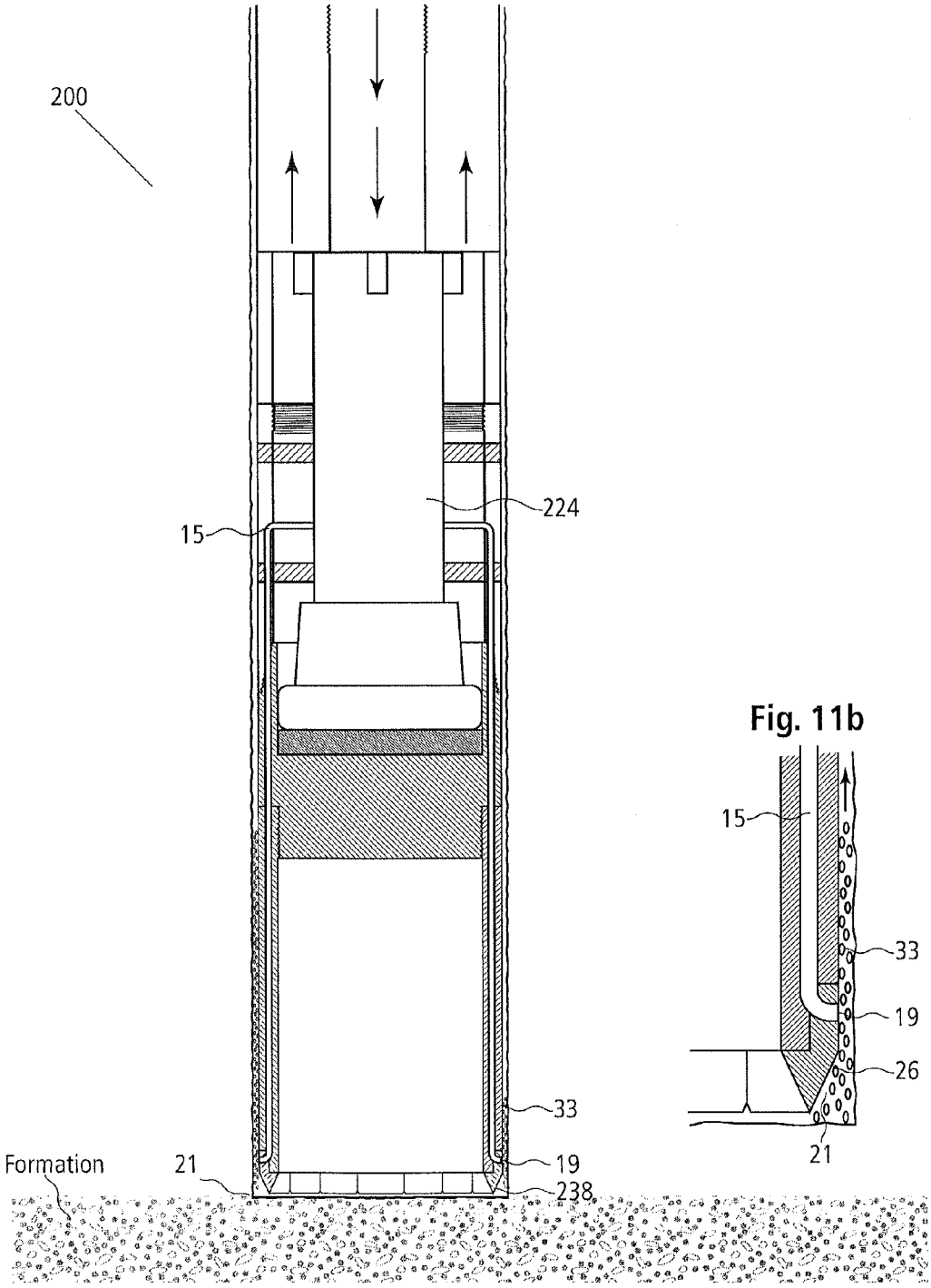
FIGS. 11*a* to 11*e* illustrate an embodiment of a pneumatic hammer coring apparatus for cleaning out debris from the borehole during coring.
Figure 11C:
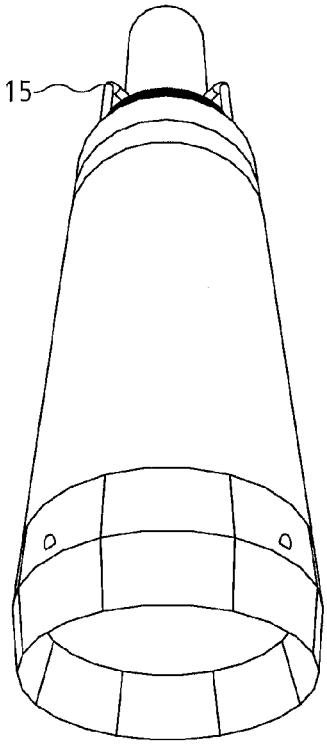
Figure 11D:
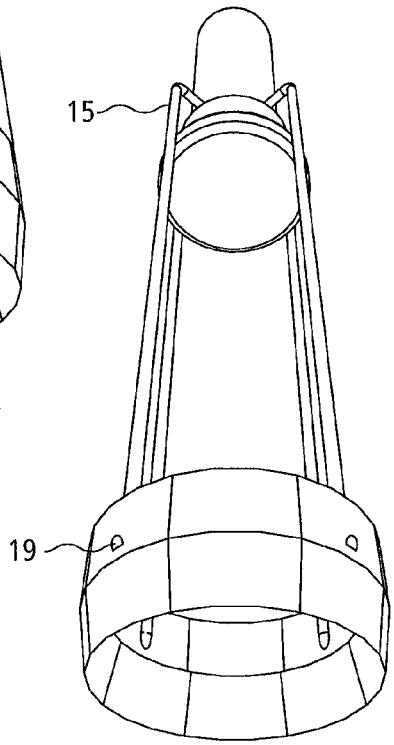
Figure 11E:
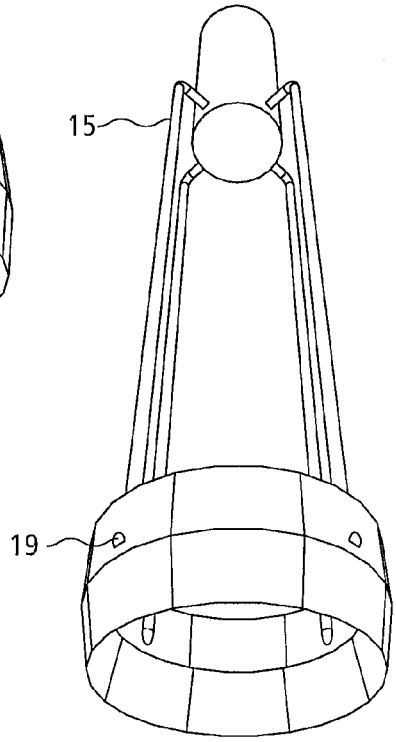

As previously mentioned, the pneumatic reciprocating hammer of the present invention can either be directly connected to the drill string by means of threaded pin 232 or can be indirectly attached to the drill string by first connecting it to a rotating sub. A rotating sub that can be used in the present invention is shown in FIG. 10. Rotating sub 278 is essentially comprised of seven main components. The upper end of top sub 282 is connected to the drill string (not shown) by a threaded connection 284.

The lower end of top sub 282 is connected to spring housing 286 by means of threaded section 290. Spring housing 286 houses return spring 288 and threaded section 292 of mandrel 294. Bottom sub 283 further contains mandrel 294 which limits its travel. Threaded box 296 located at the bottom of mandrel 294 can be connected to threaded pin 232 of pneumatic reciprocating hammer 224 by threading the two pieces together.

Longitudinal compressive force applied to the end of the rotating sub 280 results in compression of return spring 288 as the mandrel 294 retracts into the cavity formed by the apparatus of the top sub 282, the spring housing 286, and the bottom sub 283. The threaded section 290 on the top sub 282 is mated with a conjugate thread 292 on the mandrel 294 and causes the mandrel 294 and the threaded box 296 to rotate as the mandrel 294 retracts into the cavity. The rotation action is independent of fluid flow (such as compressed air), which is conducted through flow path 298.

FIGS. 11*a* to 11*e* illustrate an embodiment of a pneumatic or air hammer coring apparatus of the present invention whereby a portion of the compressed gas that is supplied to the pneumatic reciprocating hammer is also delivered to the coring bit to facilitate in the cleaning of the borehole during the coring process. In particular, pneumatic reciprocating hammer 224 further comprises at least one air line 15, which directs a portion of the supplied compressed gas to coring bit 238 having at least one exit hole 19 to release the compressed gas into the borehole 21. The debris 26 formed in the borehole 21 is picked up by the compressed gas and travels up annulus 33 formed between the wall of the coring apparatus and the wall of borehole 21. Debris 26 can then travel up through annulus 33 and up to the surface of the well for disposal.

Figure 12:
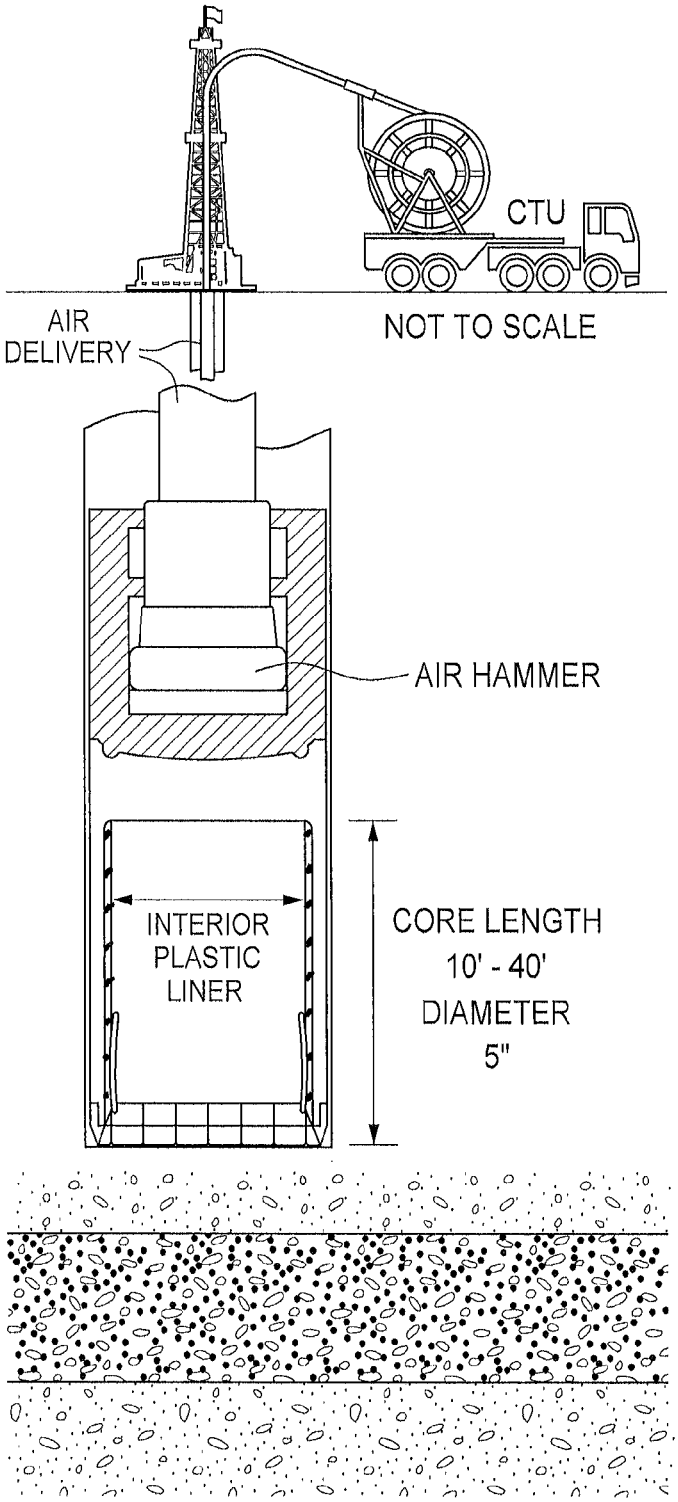
FIG. 12 schematically illustrates a coil tubing unit which can be used to operate a pneumatic hammer coring apparatus of the present invention.

FIG. 12 schematically illustrates a coil tubing unit which can be used to operate a pneumatic hammer coring apparatus of the present invention. As previously mentioned, conventional coring methods depend on the ability to rotate the drill string and thus cannot be used with coil tubing. However, use of a pneumatic reciprocating hammer together with the coring member of the present invention allows one to now use coil tubing. Thus, coring operations are much more cost and time efficient, especially when cutting hundreds of feet of core. This is of particular importance in coring in oil sands reservoirs, where routinely hundreds of feet of core are cut in each well for in situ oil sands extraction processes such as Steam Assisted Gravity Drainage (SAGD).

Figure 13A:
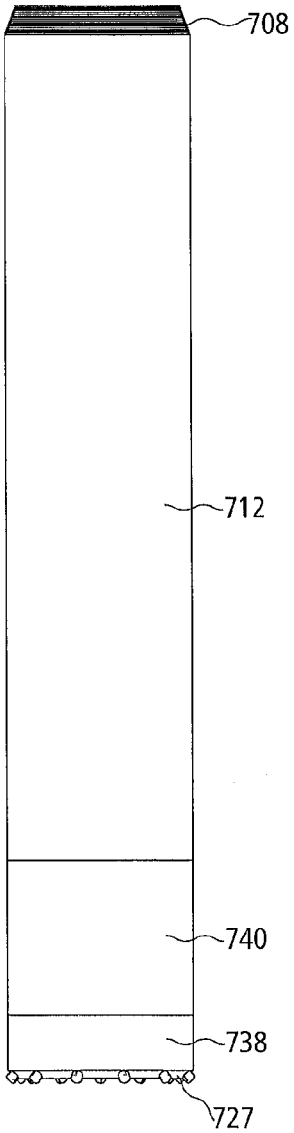
FIGS. 13*a* and 13*b* are perspective views of an embodiment of an assembled and disassembled, respectively, coring barrel.
Figure 13B:
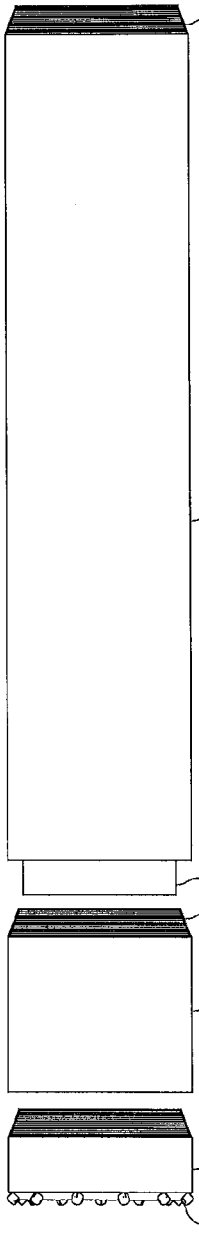
Figure 13C:
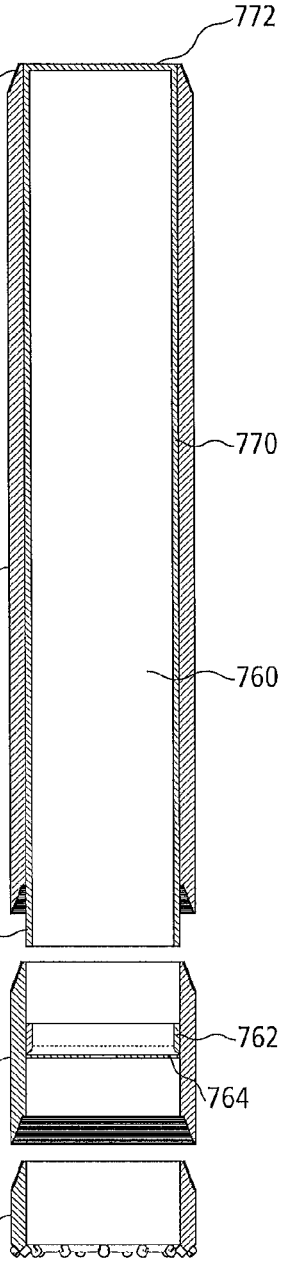
FIG. 13*c* is a vertical cross-section of the disassembled coring barrel shown in FIG. 13*b*.

As previously mentioned, the air hammer coring apparatus of the present application can be used to cut a pressure core. With reference first to FIGS. 13*a*-13*c*, in this embodiment, coring barrel 712 is attached to impact sub (not shown) by threaded pin end 708. The interior of coring barrel 712 is lined with core liner 770, which may be made from plastic or other like materials as known in the art. In this embodiment, liner 770 is closed or sealed at the top 772. The core liner is designed to receive the core sample 760 and facilitate its removal once the core sample is at surface.

As can be seen in both FIGS. 13*b* and 13*c*, the lower end 774 of core liner 770 extends out the bottom of coring barrel 712, and, in some instances, the lower end and unsealed upper end of the liner can be threaded so that joints of core liner can be threaded together when multiple lengths are required, for example, when more that one coring barrel is used.

Figure 13D:
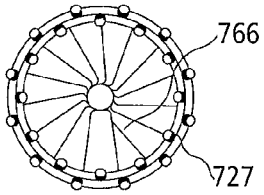
FIG. 13*d* shows the bottom of the coring barrel of FIGS. 13*a*-13*c*.

Core catcher 740 is threaded to coring barrel 712 by means of threads 742 and coring bit 738 comprising a plurality of core cutters 727 is threaded to core catcher 740 by means of threads 742. Core catcher 740 further comprises chemical container 762, which can be a pliable bladder or bag and which contains a chemical sealant 764 for sealing the bottom of the core sample when coring is completed. Chemical container 762 may be made of a material such as rubber, plastic or the like, and is designed to release its contents (i.e., sealant) when coring is completed. It is understood that in some embodiments, the chemical container can be located at the bottom of the coring barrel, in which case the core liner would not extend past the chemical container. FIG. 13*d* is a bottom view of the assembled coring barrel 712, core catcher 740 and coring bit 738, and shows blades 766 of core catcher 740 in the closed position, prior to the start of the coring operation.

Figure 14A:
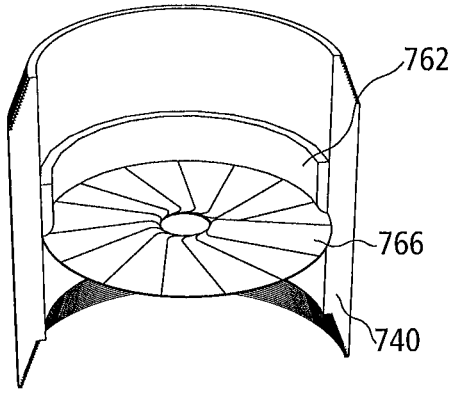
FIGS. 14*a*, 14*b* and 14*c* are a series of perspective cross-sectional view of an embodiment of a core catcher in operation during coring.
Figure 14B:
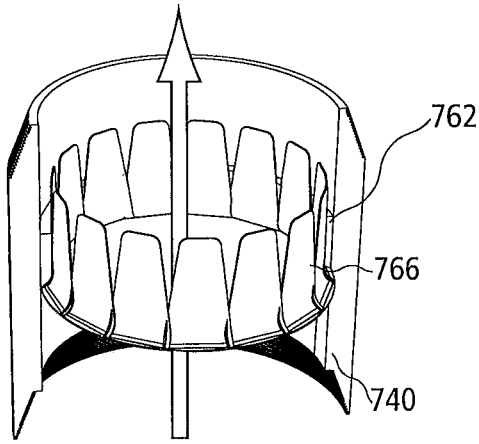
Figure 14C:
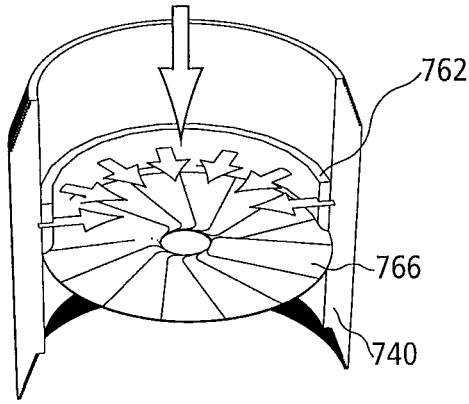

FIGS. 14*a*-14*c* are cutaway perspectives of the operation of core catcher 740 during coring. FIG. 14*a* shows core catcher 740 in the closed position prior to commencement of coring. In this embodiment, chemical container 762 is positioned just above core catcher blades 766. Once the coring operation begins, as shown by the arrow in FIG. 14*b*, the core sample entering core catcher 740 will cause blades 766 to open and protect chemical container 762 from contacting the core sample. When the core sample reaches the top of the coring barrel (not shown), which may be lined with a core liner having an enclosed top and an open bottom for receiving the core sample, the coring operation is complete.

When coring is completed, the weight of the core sample, as illustrated by the downwardly pointing arrow in FIG. 14*c*, will cause the blades 766 of core catcher 740 to move downwardly into the closed position again. The blades 766 will cut off the core and the weight of the core sample and/or the closing of the blades 766 will rupture the now-exposed chemical container 762 and the sealant contained therein will be released to seal the bottom of the cut core sample. In the alternative, the core catcher can be further equipped with a mechanism for signaling the release of the chemicals once the core catcher 740 closes when coring is completed.

In some instances, it may be desirable to use a core liner that is open at both its top and bottom (a core liner sleeve). In this embodiment, it may be desirable to have a second chemical container located inside the coring barrel at or near its top for holding a sealant to seal the top of the core sample when coring is completed.

Thus, the core sample will now be sealed in the core liner and can be removed from the wellbore and shipped to a core lab for evaluation with all the fluids in an essentially pristine and uncontaminated state.

Figure 15A:
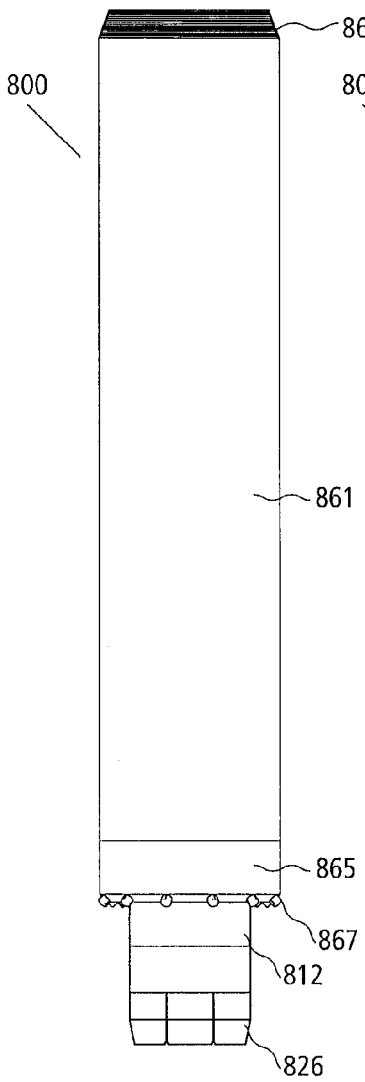
FIGS. 15*a*, 15*b*, 15*c* and are 15*d* a perspective view, a partial vertical cross-section, a vertical cross-section and a perspective view of the bottom, respectively, of an embodiment of a concentric coring barrel.
Figure 15B:
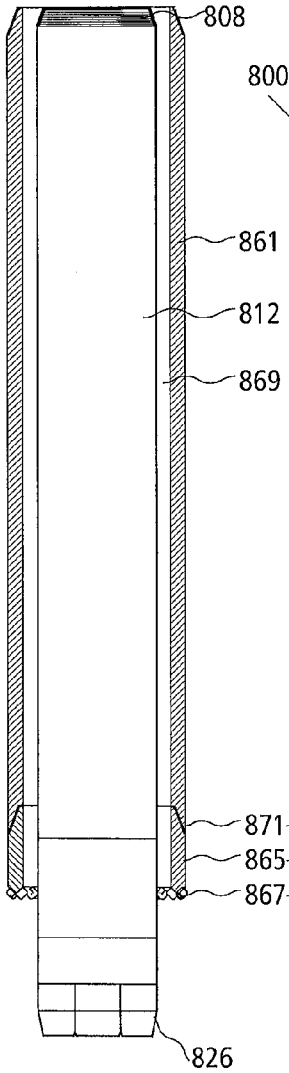
Figure 15C:
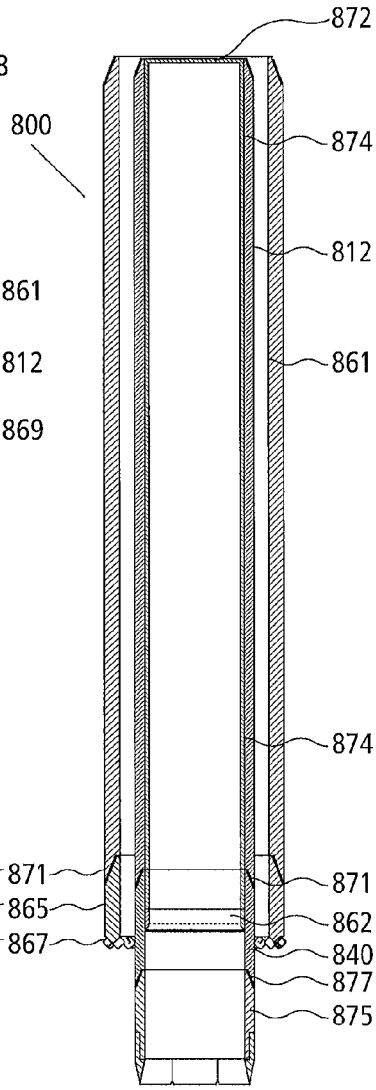

FIGS. 15*a*, 15*b* and 15*c* are a perspective view, partial vertical cross-section and vertical cross-section, respectively, of a concentric coring barrel 800 that can be used to simultaneously drill a wellbore and obtain a core sample. The concentric coring barrel 800 comprises an inner coring barrel 812 and an outer tube 861. Inner coring barrel 812 further comprises at least one chisel cutter 826 for cutting into the formation and forming the core sample, wherein the at least one chisel cutter is either directly attached to the inner coring barrel 812 or forms part of a separate chisel bit 875, which chisel bit 875 can then be attached directly or indirectly to the bottom of the inner coring barrel 812 by threads 877.

Outer tube 861 further comprises a coring bit 865 having a plurality of cutters 867, said coring bit 865 having an outer dimension that is larger than the outer dimension of the coring apparatus and drill string so that the coring apparatus does not get stuck in the hole. Further, the outer dimension of the coring bit 865 is such that the desired size of wellbore will be cut or drilled so that additional drilling will not be necessary once the coring process is completed. It is understood that the coring bit may be a chisel bit, a button bit or other types of coring bits known in the art.

In one embodiment, the outer tube 861 is threaded at the top (threads 863) so that it can be threaded to the bottom of the impact anvil. The coring barrel 812 may also be threaded at the top (threads 808) so that it can be threaded to the bottom of the impact anvil as well, although, as previously described, it can be integral with the impact anvil.

Figure 15D:
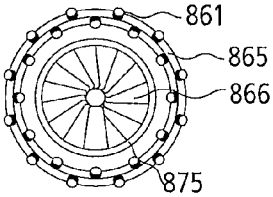

As can be more clearly seen in FIG. 15*c*, the inner coring barrel 812 may also have a core catcher 840 attached thereto by threads 871 for cutting and/or retaining the core sample once coring/drilling is completed. Core catcher 840 comprises a plurality of blades 866, which blades are horizontally extended when the core catcher 862 is in the closed position (see FIG. 15*d*). Inner core barrel 812 can be lined with core liner 874 having a closed top 872. A chemical container 862 can be positioned at or near the bottom of the core liner 874 for holding a sealant for sealing the bottom of the core sample once coring is completed. A second chemical container 864 containing a sealant may also be provided at or near the top of the core liner for sealing the top of the core sample.

I claim:

1. A coring apparatus for extracting a core sample from a subterranean formation, comprising:

a rotating sub having a first end for operatively connecting the rotating sub to a drill string, and a second end;

a pneumatic reciprocating hammer having a first end for operatively connecting the pneumatic reciprocating hammer to the second end of the rotating sub, a second end having a hammer bit, and a reciprocating piston for reciprocating the hammer bit; and a coring member operatively connected to the pneumatic reciprocation hammer, the coring member comprising an impact anvil and a hollow coring barrel forming an internal longitudinal chamber for accommodating the core sample, the coring barrel positioned below the impact anvil such that when the hammer bit strikes the impact anvil, the coring barrel is driven into the formation and the core sample is extracted into the internal longitudinal chamber of the coring barrel;

whereby the rotating sub rotates the pneumatic reciprocating hammer and coring member to aid in the extraction of the core sample.

2. The coring apparatus as claimed in claim 1, wherein the coring barrel comprises at least one cutter at its lower end for cutting into the formation.

3. The coring apparatus as claimed in claim 2, wherein the at least one cutter is a polycrystalline diamond compact cutter.

4. The coring apparatus as claimed in claim 2, further comprising a carrier for housing the pneumatic reciprocating hammer.

5. The coring apparatus as claimed in claim 4, wherein the carrier comprises at least one locking mechanism for locking the pneumatic reciprocating hammer in the carrier.

6. The coring apparatus as claimed in claim 1, further comprising a surface compressor for providing gas to operate the pneumatic reciprocating hammer.

7. The coring apparatus as claimed in claim 1, wherein the drill string is selected from the group consisting of single wall drill pipe, dual wall drill pipe, single wall coiled tubing and dual wall coiled tubing.

8. The coring apparatus as claimed in claim 1, wherein the pneumatic reciprocating hammer is a reverse circulating air hammer.

9. The coring apparatus as claimed in claim 1, wherein the impact anvil is made of a hardened material selected from the group consisting of stainless steel, tungsten carbide, brass and carbon steel with industrial diamond coating, or combinations thereof.

10. The coring apparatus as claimed in claim 1, wherein the coring barrel is removably attached to the impact anvil by means of interlocking threads.

11. The coring apparatus as claimed in claim 1, wherein the coring barrel further comprises spring loaded stoppers at its lower end to ensure that the core sample is retained within the coring barrel when the air hammer coring apparatus is removed from the subterranean formation.

12. The coring apparatus as claimed in claim 1, further comprising a surface blowout preventer.

13. The coring apparatus as claimed in claim 1, the coring member further comprising an outer tube surrounding the coring barrel and forming an annulus between the outer tube and coring barrel for receiving and removing cuttings formed during the coring process.

14. The coring apparatus as claimed in claim 13, the coring member further comprising a coring bit operatively attached to the lower end of the outer tuber.

15. A coring apparatus for extracting a core sample from a subterranean formation, comprising:

a pneumatic reciprocating hammer having a first end for operatively connecting to a drill string, a second end having a hammer bit and a reciprocating piston for reciprocating the hammer bit;

a coring member operatively connected to the pneumatic reciprocating hammer, the coring member comprising an impact anvil and a hollow coring barrel forming an internal longitudinal chamber for accommodating the core sample, the coring barrel positioned below the impact anvil and lined with a core liner having a closed top and an open bottom for receiving and enveloping the core sample;

a core catcher secured to the lower end of the coring barrel, said core catcher comprising a plurality of blades for either cutting off the core sample when coring is completed, retaining the core sample in the coring barrel, or both;

a coring bit secured to the lower end of the core catcher for cutting through the formation to obtain the core sample; and a first chemical container located at or near the bottom of the coring barrel for holding a sealant for sealing the bottom of the core sample once the core sample has been cut.

16. The coring apparatus as claimed in claim 15, wherein the coring member is operatively connected to the pneumatic reciprocating hammer by means of a carrier housing of the pneumatic reciprocating hammer.

17. The coring apparatus as claimed in claim 15, wherein the coring bit has an outer dimension greater than the outer dimension of the coring apparatus.

18. The coring apparatus as claimed in claim 15, the coring member further comprising an outer tube surrounding the coring barrel and forming an annulus between the outer tube and coring barrel for receiving and removing cuttings formed during the coring process.

19. The coring apparatus as claimed in claim 18, the coring member further comprising a coring bit operatively attached to the lower end of the outer tuber.

20. A method for obtaining a core sample from a subterranean formation and/or drilling a hydrocarbon well, comprising:

operatively connecting a rotating sub to a drill string;

operatively connecting an upper end of a pneumatic reciprocating hammer to the rotating sub, the pneumatic reciprocating hammer having a hammer bit at its lower end;

operatively connecting a coring member to the pneumatic reciprocating hammer, the coring member comprising an impact anvil and a hollow coring barrel forming an internal longitudinal chamber for accommodating the core sample, the coring barrel positioned below the impact anvil; and supplying a gas through the drill string to the pneumatic reciprocating hammer for operating the pneumatic reciprocating hammer so that the hammer bit repeatedly strikes the impact anvil to force the coring barrel into the formation and cut out the core sample;

whereby the rotating sub rotates the pneumatic reciprocating hammer and the coring member to aid in the cutting of the core sample.

21. The method as claimed in claim 20, further comprising sealing the bottom, top, or both, of the core sample with a sealant when coring or drilling is completed.

22. The method as claimed in claim 21, further comprising enveloping the core sample with a core liner.

23. The method as claimed in claim 20, further comprising cutting off the core sample when coring or drilling is completed.

24. The method as claimed in claim 20, wherein the coring barrel further comprises a coring bit.

25. The method as claimed in claim 24, wherein the coring bit has an outer dimension sufficient to ensure that the drill string, pneumatic reciprocating hammer and coring member are moveable axially in the cored formation.

26. The method as claimed in claim 24, wherein the coring bit has an outer dimension sufficient to drill a borehole substantially having the same inner diameter as the original borehole of the hydrocarbon well.

27. The method as claimed in claim 20, wherein the coring member further comprises an outer tube surrounding the coring barrel and forming an annulus between the outer tube and coring barrel for receiving excess cuttings formed during the coring or drilling process.

28. The method as claimed in claim 27, the coring member further comprising a coring bit operatively attached to the lower end of the outer tuber.

29. The method as claimed in claim 27, wherein the coring member further comprises a first coring bit operatively attached to the lower end of the coring barrel and a second coring bit operatively attached to the lower end of the outer tube.

30. A coring apparatus for extracting a core sample from a subterranean formation, comprising:

a rotating sub having a first end for operatively connecting the rotating sub to a drill string, and a second end;

a pneumatic reciprocating hammer having a first end for operatively connecting the pneumatic reciprocating hammer to the second end of the rotating sub, a second end having a hammer bit and a reciprocating piston for reciprocating the hammer bit; and an impact anvil operatively connected to the pneumatic reciprocation hammer having a first end for receiving strikes from the reciprocating hammer bit, said impact anvil having a second end operable for removably receiving a hollow coring barrel having a singular wall forming an internal longitudinal chamber for accommodating the core sample;

whereby when the hammer bit strikes the impact anvil, the coring barrel is driven into the formation, the core sample is extracted into the internal longitudinal chamber of the coring barrel, and the coring barrel can be removed from the impact hammer for analysis of the core sample.

31. The coring apparatus as claimed in claim 30, wherein the coring barrel comprises at least one cutter at its lower end for cutting into the formation.

32. The coring apparatus as claimed in claim 31, wherein the at least one cutter is a polycrystalline diamond compact cutter.

33. The coring apparatus as claimed in claim 30, wherein the impact anvil is made of a hardened material selected from the group consisting of stainless steel, tungsten carbide, brass and carbon steel with industrial diamond coating, or combinations thereof.

34. The coring apparatus as claimed in claim 30, wherein the coring barrel is removably attached to the impact anvil by means of interlocking threads.

35. The coring apparatus as claimed in claim 30, wherein the coring barrel further comprises spring loaded stoppers at its lower end to ensure that the core sample is retained within the coring barrel when the air hammer coring apparatus is removed from the subterranean formation.

36. A coring apparatus for extracting a core sample from a subterranean formation, comprising:

a pneumatic reciprocating hammer having a first end for operatively connecting to a drill string, a second end having a hammer bit and a reciprocating piston for reciprocating the hammer bit;

a coring member operatively connected to the pneumatic reciprocating hammer, the coring member comprising an impact anvil and a hollow coring barrel forming an internal longitudinal chamber for accommodating the core sample, the coring barrel positioned below the impact anvil and lined with a core liner for enveloping the core sample;

a core catcher secured to the lower end of the coring barrel, said core catcher comprising a plurality of blades for either cutting off the core sample when coring is completed, retaining the core sample in the coring barrel, or both;

a coring bit secured to the lower end of the core catcher for cutting through the formation to obtain the core sample;

a first chemical container located at or near the bottom of the coring barrel for holding a sealant for sealing the bottom of the core sample once the core sample has been cut; and a second chemical container located at or near the top of the coring barrel for holding a sealant for sealing the top of the core sample when coring is completed.

* * * * *